United States Patent [19]

Separovich

[11] Patent Number: 5,071,286

[45] Date of Patent: Dec. 10, 1991

[54] FLOATING BOOM FOR CONFINING WATERBORNE CONTAMINATES

[76] Inventor: Robert A. Separovich, 1702 8th, Anacortes, Wash. 98221

[21] Appl. No.: 436,438

[22] Filed: Nov. 13, 1989

[51] Int. Cl.[5] ..... E02B 15/04

[52] U.S. Cl. ..... 405/66; 405/70; 405/72

[58] Field of Search ..... 405/63, 64, 65, 66, 405/67, 68, 69, 70, 71, 72

[56] References Cited

U.S. PATENT DOCUMENTS

| | | | |
|---|---|---|---|
| 2,682,151 | 6/1954 | Simpson et al. | 405/68 |
| 3,611,728 | 10/1971 | Van'T Hof | 405/72 |
| 3,631,679 | 1/1972 | Fisch | 405/68 |
| 3,686,870 | 8/1972 | Blomberg | 405/72 X |
| 3,708,982 | 1/1973 | Blockwick | 405/68 X |
| 3,839,870 | 10/1974 | Ryan | 405/64 |
| 3,852,965 | 12/1974 | Rudd | 405/72 |
| 3,852,978 | 12/1974 | Fossberg | 405/67 |
| 3,919,847 | 11/1975 | Ballu | 405/63 |
| 3,922,862 | 12/1975 | Vidilles | 405/68 |
| 3,998,060 | 12/1976 | Preus | 405/70 |
| 4,006,082 | 2/1977 | Irons | 405/63 X |
| 4,104,884 | 8/1978 | Preus | 405/68 |
| 4,190,381 | 2/1980 | Knaus et al. | 405/72 |
| 4,249,834 | 2/1981 | Bouvier | 405/63 X |
| 4,272,214 | 6/1981 | Nyfeldt et al. | 405/72 |
| 4,320,991 | 3/1982 | Rogers | 405/68 |

FOREIGN PATENT DOCUMENTS

| | | | |
|---|---|---|---|
| 148815 | 11/1980 | Japan | 405/63 |
| WO86/04942 | 8/1986 | PCT Int'l Appl. | 405/70 |

*Primary Examiner*—Dennis L. Taylor
*Assistant Examiner*—Arlen L. Olsen
*Attorney, Agent, or Firm*—Hughes & Multer

[57] ABSTRACT

A horizontally elongate floating boom for confining contaminate material floating on the surface of a body of water. There is a flotation section having a substantially vertical contaminate impervious skirt section extending downwardly therefrom. The skirt section has first and second ends which are adapted to overlap one another. A substantially vertical net section extends downwardly from the skirt section, and has a ballast section attached along a lower edge thereof. Apparatus is provided for securing a first end of a skirt section and a second end of a skirt section together when they are overlapped. In a first embodiment, the ballast section is adapted to rest on the floor of the body of water so as to maintain the boom in a fixed position. In a second embodiment, apparatus is provided for contracting the boom about a portion of the body of water which is encircled by the boom. The contracting apparatus may be a first purse line attached to the flotation section, a second purse line attached to the lower edge of the skirt section, and a third purse line attached to the lower edge of the net section.

30 Claims, 9 Drawing Sheets

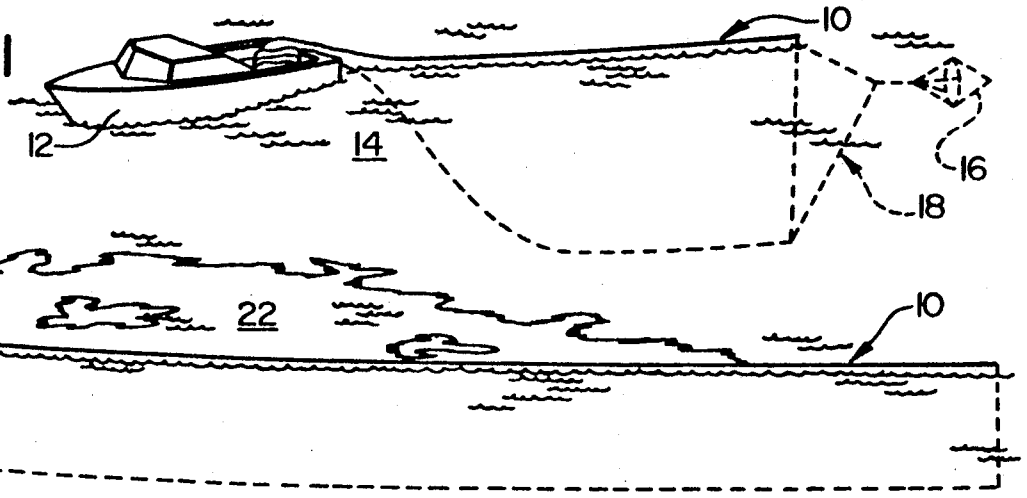
FIG. 1
FIG. 2
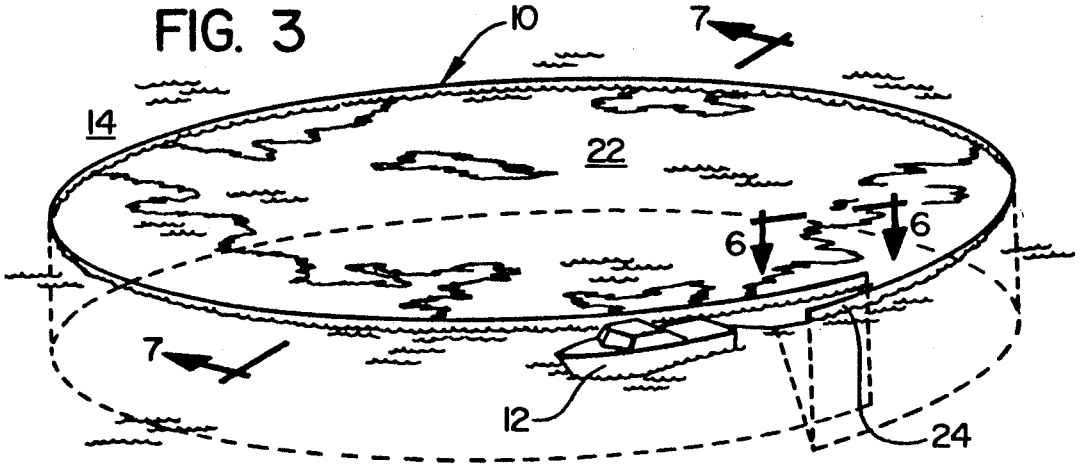
FIG. 3
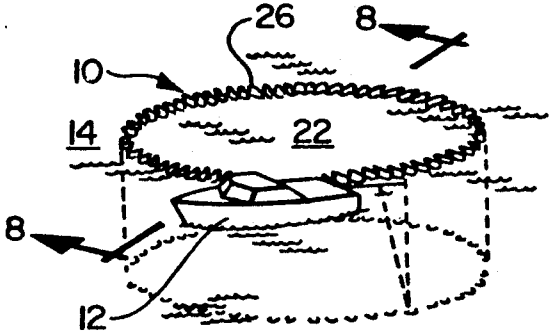
FIG. 4

FLOATING BOOM FOR CONFINING WATERBORNE CONTAMINATES

BACKGROUND OF THE INVENTION

1. Field of the Invention

The present invention relates to an apparatus and method for containment of waterborne contaminates. More particularly, the present invention relates to an oil spill containment boom having a substantially vertical skirt section extending downwardly into the body of water, which skirt section can be overlapped and secured together so as to prevent the escape of the captured oil.

2. Background Art

The harmful effects of a wide variety of waterborne contaminates, both to the natural environment and to the human population, are well known. While any number of substances may form harmful waterborne contaminates, a particularly common and egregious example is oil spills. Oil spills typically may originate from either naturally occurring or accidental man-made hydrocarbon leaks. Accidental oil spills originate from a wide variety of sources, including, by way of example: offshore platforms, oil transfer facilities, shoreline refineries, and oil tankers. Accordingly, such accidental spills may take place in either open water or coastal areas. Typically, oil spills in open ocean areas take the form of thin, isolated slicks floating on the surface of deep water. Oil spills in coastal areas, however, may form slicks in shallow water bays, estuaries, rivers, etc., which are subject to significant current and tidal forces.

Many oil spill booms for retaining or cleaning up such oil spills are well known to those skilled in the art. Traditionally, such booms have taken the form of elongate floating barriers having a shallow skirt section which extends downwardly into the water. Such booms are traditionally towed in a "U"-shaped configuration by two vessels so as to collect the floating oil between the open ends of the boom. One such typical boom is that disclosed in U.S. Pat. No. 3,852,965 (Issued Dec. 10, 1974 to Rudd). Rudd discloses a boom having a floating surface barrier with a relatively short (approximately 4 foot) depending curtain. The lower-most portion of the curtain is open for the passage of water. A tow line is attached to the bottom of the skirt for pulling the lower portion of the curtain in advance of the floating barrier. The boom is adapted to be towed behind two vessels. As the boom is towed through the water, the floating material to be collected accumulates in front of the floating member and skirt and the excess water flows through the open portion of the curtain. Another traditional "U"-shaped floating boom is disclosed in U.S. Pat. No. 3,922,862 (Issued Dec. 2, 1975 to Vidilles). Vidilles discloses a boom having an upper float element, below which is a relatively shallow skirt. The skirt tapers from having a deeper section at the mid-point of the boom towards the surface at either end of the boom. Accordingly, the skirt is intended to entrain water and pollutants only near the vertex of the "U", so as to avoid entraining additional water near the leading edges of the "U". A tow chain is attached along the lower edge of the skirt so as to provide ballast which maintains the skirt at its proper depth. Yet another such skimming boom is disclosed in U.S. Pat. No. 3,686,870 (Issued Aug. 29, 1972 to Blomberg). Blomberg discloses a boom having a stress relieving rope connected at points situated along its length so that the total stress exercised by the water resistance when the boom is towed through the body of water will be taken up by the stress relieving rope, whereby each section of the boom is only subjected to the water resistance stress actuating upon that individual section. The boom is provided with floats along the upper edge of the skirt, and sinking weights along the lower edge of the skirt. The skirt is attached to the stress relieving rope by means of tethers, such as supporting wires. The main purpose of the stress relieving rope described by Blomberg appears to be to relieve the towing stress exerted on each individual panel or section of the boom. Although Blomberg states that the stress relieving rope can be used to haul in each individual section separately if the boom is going to be brought home or pursed around leaked out oil, Blomberg does not appear to teach or suggest that the boom may be used to completely enclose or confine an oil slick.

While such conventional "U"-shaped booms may prove helpful in cleaning up oil slicks, they typically exhibit a number of drawbacks and disadvantages. For example, such "U"-shaped booms typically require the services of two tugs, boats, or other watercraft to tow them through the water. Typically, a watercraft is attached to either end of the "U", and the pair of craft proceed on parallel courses so as to maintain the boom in its proper orientation. The craft maneuver the "U"-shaped boom through contaminated areas so as to collect or "sweep up " floating oil from the surface of the water. It is readily apparent that each additional craft required for an operation significantly increases total costs. Furthermore, in the event of a catastrophic spill, it is highly likely that there will be a shortage of available clean-up craft. Accordingly, there is need for an apparatus method which would permit the clean-up of spilled contaminants using fewer craft.

Another disadvantage of the traditional "U"-shaped skimmer booms is that they require continued forward motion of the craft to keep the oil or other contaminates contained within the vertex of the "U" shaped collection area. Unless a harbor skimmer or other oil removal means is readily available to remove the collected materials once the forward movement of the towing craft has ceased, the spill will immediately commence spreading again over the surface of the water. Such harbor skimmers or other removal means are typically very expensive, and would also likely be in very short supply in the event of a major spill. Furthermore, since only the forward motion of the boom through the water serves to collect and compress the oil into a compact mass within the boom, once the motion of the boom stops, even if collection craft are available, the slick will immediately begin to spread out as a thin film over the surface of the water. Collection of such a thin slick is typically accomplished by means of a conventional harbor skimmer, and is both time consuming and highly inefficient. Such conventional harbor skimmers tend to collect a great deal of water with the oil, and their collection capacity is soon reached. It would be much more efficient to collect and maintain the oil slick in a compact, fairly thick mass at the surface of the water from which it could be efficiently pumped or drawn by a collection craft. Accordingly, there is a need for an apparatus and method for collecting and storing floating contaminates such as oil in a relatively compact mass until a removal craft becomes available.

Still further, because traditional "U"-shaped skimmer booms must be drawn through the water in order to collect the oil slick, significant difficulties with spillage of the collected oil over and under the booms has been encountered in the practice of such techniques. These difficulties are aggravated by heavy weather, since the forward motion of the boom though the body of water creates additional turbulence which adds to the ambient turbulence of the wave action. Such booms can also easily be damaged by floating debris such as logs, or by fixed objects such as rocks; in the event that the towing craft maneuver to avoid such hazards, significant portions of the surface of the body of water may be left unswept. Accordingly, there is a need for a technique by which oil slicks and other contaminates floating on a body of water can be captured without sweeping through the water with a boom.

SUMMARY OF THE INVENTION

The present invention, in its broadest sense, resides in a floating boom having a skirt which may be overlapped and secured together to confine floating contaminate material. The boom has a flotation section for floating on the surface of the body of water. A substantially vertical contaminate impervious skirt section extends downwardly from the flotation section for retaining the contaminate material. The skirt section has first and second ends which have edges extending downwardly from the surface, which ends are adapted to overlap one another. A substantially vertical net section extends downwardly from the skirt section, for permitting the flow of subsurface water therethrough. A ballast section is attached along a lower edge of the net section for maintaining the skirt section and net section in substantially vertical orientation. Means are provided for securing the first and second ends of the skirt section together when the first and section ends are overlapped, so as to prevent the escape of the contaminate material from an area of the surface of the body of water which is surrounded by the boom.

In a first embodiment, the boom has a ballast section which is adapted to rest on the floor of the body of water so as to maintain the boom in a substantially fixed position. The ballast section may be a lead line having weight in the range from approximately 10–12 pounds per fathom. The means for securing the overlapped first and second ends of the skirt section together may be a substantially vertical row of loops attached to the skirt section proximate the first end of the skirt section, and a corresponding substantially vertical row of hooks attached to the skirt section proximate the second end of the skirt section for engaging the row of loops. This embodiment of the boom may be used for catching contaminate material floating on the surface of the body of water by placing a first end of the boom is the body of water, so that the lead line anchors the first end of the boom on a substantially fixed position relative to the floor of the body of water, and then paying out the remainder of the boom from a moving watercraft so as to segregate or surround a portion of the body of water having the contaminate material floating thereon. The second end of the skirt section may then be overlapped against the first end of the skirt section so as to enclose a portion of the body of water which is surrounded by the boom. The overlapped first and second ends of the skirt section are then secured together so as to prevent the escape of the contaminate material.

In a second embodiment of the invention, the boom is provided with means for contracting the boom about a portion of the body of water which is surrounded by the boom. The contracting means may comprise a first purse line attached along the flotation section proximate the surface of the body of water, a second purse line attached along a lower edge of the skirt section, and a third purse line attached along a lower edge of the net section, so that tension applied to an end of each purse line will cause its respective section to contract about the portion of the body of water which is surrounded by the boom. The flotation section may comprise a plurality of float pockets arranged in a substantially horizontal row, each float pocket having flotation material contained therein and having an accordion pleat attached thereto intermediate each float pocket and the next float pocket in the row, so that each float pocket folds against the next float pocket in the row as the flotation section contracts. The boom may be further provided with anchoring means, such as a sea anchor, for holding an end of the boom substantially stationary in the body of water.

To catch contaminate material floating on the surface of the body of water, the boom may be placed in the body of water and the sea anchor attached to the first end of the boom. The boom is towed from a watercraft attached to the second end of the boom along a path around a portion of the body of water having the contaminate material floating thereon, so as to encircle that portion of the body of water with the boom. The first and second ends of the skirt section are overlapped so as to enclose the portion of the body of water which is encircled by the boom. The overlapped first and second ends of the skirt section are then secured together so as to prevent the escape of the contaminate material from the portion of the body of water which is encircled by the boom. Tension is then applied to the ends of the first, second, and third purse lines so as to contract the flotation section, skirt section, and net section about the portion of the body of water which is surrounded by the boom, so as to gather the contaminate material into a more compact mass for removal. The lower edge of the net section may be contracted so as to cinch it closed, so that solid portions of the contaminate material which may sink while awaiting removal are retained by the boom. To remove the surrounded contaminate material from the body of water, the flotation section and the lower edge of the skirt section may be contracted so as to cinch them closed, and the boom may be hoisted out of the body of water with the contaminate material enclosed therein.

These and other features of the present invention will become apparent from the following detailed description.

BRIEF DESCRIPTION OF THE DRAWINGS

FIG. 1 is a perspective view of a boom in accordance with present invention in the initial stages of deployment from a moving watercraft.

FIG. 2 is a perspective view of a boom in accordance with present invention which has been completely deployed in a body of water proximate floating contaminate material, such as an oil slick.

FIG. 3 is a perspective view of the boom of FIG. 2 which has been towed through the body of water so that the boom surrounds the oil slick and the first and second ends of the skirt section of the boom are overlapped.

FIG. 4 is a perspective view of the boom of FIG. 3 as it is contracted about the portion of the body of water which it surrounds.

DESCRIPTION OF THE PREFERRED EMBODIMENTS

Figure 5A:
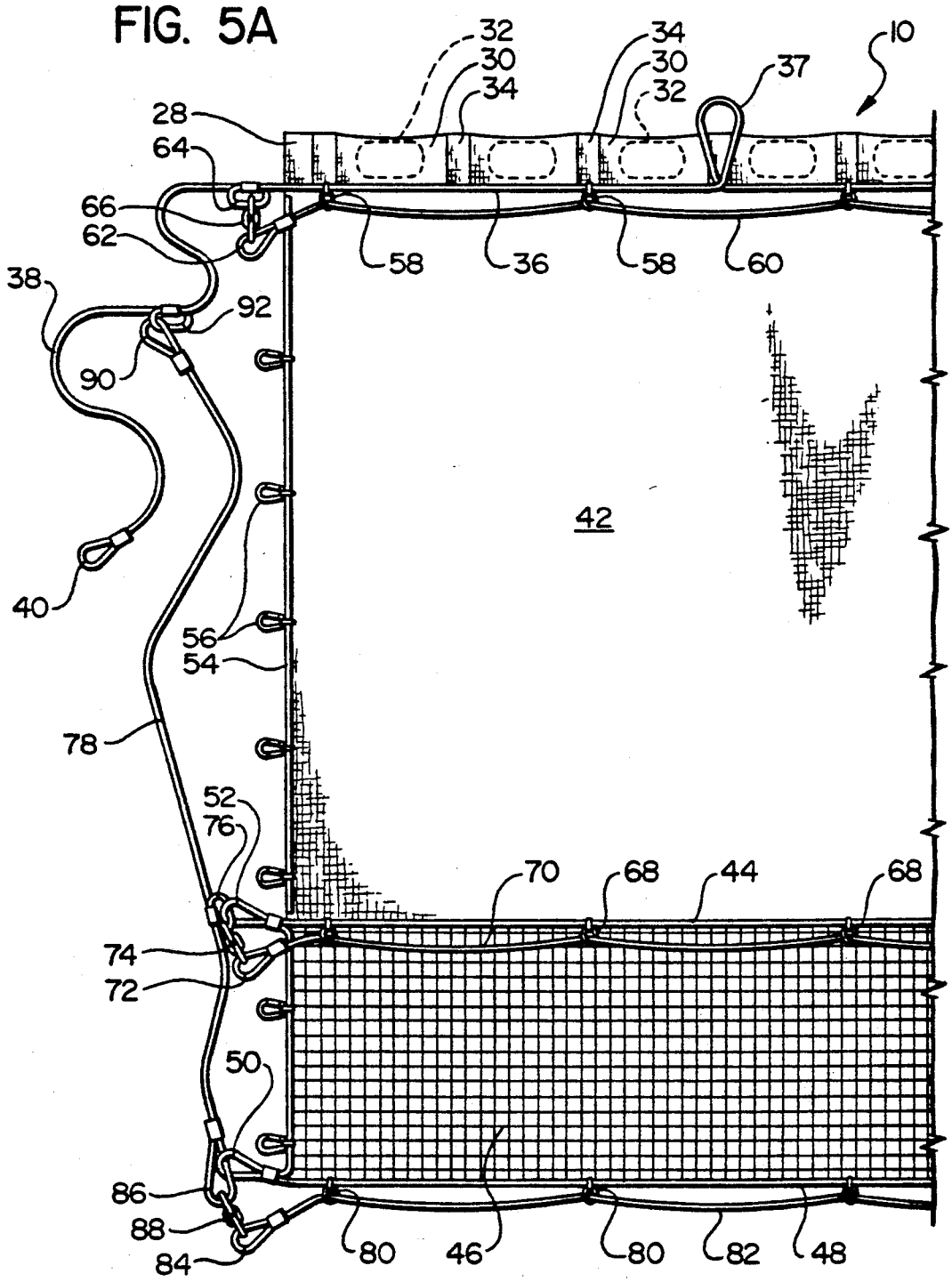
FIG. 5A is a side elevational view of a first end of a boom in accordance with the present invention which is adapted to surround and contract about portions of bodies of water having contaminate material floating thereon in the manner shown in FIGS. 3 and 4.

With reference to FIG. 1, there is shown a boom incorporating the present invention, with this boom being shown in the initial stages of deployment from a moving watercraft. The boom 10 is shown being paid out over the stern of moving watercraft 12 into body of water 14. A sea anchor 16 is attached to the end of boom 10 opposite watercraft 12 by a tow line or bridle assembly 18 so as to hold that end of the boom relatively stationary in the body of water. The sea anchor is preferably approximately 6–8 feet in diameter. With the end of boom 10 held relatively stationary in body of water 14 by sea anchor 16, the remainder of boom 10 is readily deployed by mobile watercraft 12 by simply moving watercraft 12 forward and continuing to pay boom 10 out over the stern of watercraft 12.

With reference now to FIG. 2, there is shown the boom 10 of FIG. 1 as it is completely deployed in body of water 14 from watercraft 12. It will be seen that boom 10 has a generally horizontally elongate form, most preferably 1200–1500 feet long, and extends vertically downwardly into body of water 14 a significant distance. Boom 10 is attached to watercraft 12 by means of a tow line 20. It will be noted that boom 10 is not towed in the convention "U"-shaped skimming form from two vessels; rather, boom 10 is easily towed relatively longitudinally through body of water 14 by a single watercraft 12. Accordingly, the present invention avoids the expense, inefficiency, and difficulties associated with the traditional two-boat techniques. Boom 10 is towed relatively longitudinally by watercraft 12 until it is proximate a mass of the contaminate material to be captured or collected, which in FIG. 2 is an oil slick 22. Preferably, the initial deployment step shown in FIG. 1 is conducted sufficiently close to the mass of contaminate material to be captured, so that watercraft 12 is not required to tow boom 10 a significant distance with sea anchor 16 deployed.

With reference now to FIG. 3, there is shown the boom of FIG. 2, as it has been towed by watercraft 12 so as to surround at least a portion of oil slick 22. Watercraft 12 is maneuvered so that boom 10 completely segregates a portion of body of water 14 having oil slick 22 floating thereon, in this case by encircling the portion of the body of water, and an overlap 24 of first and second ends of boom 10 is formed. The overlapping ends of boom 10 are then secured together, as will be described in greater detail below, so as to prevent the escape of oil slick 22 from the portion of the body of water 14 which is encircled by boom 10.

With reference now to FIG. 4, there is shown the boom of FIG. 3, as it is contracted about the portion of body of water 14 which is surrounded by boom 10. As will be described in greater detail below, this contraction of boom 10 is preferably accomplished by applying tension to, or heaving in on, the ends of purse lines which are attached to boom 10. It will be observed that as boom 10 is contracted, the flotation section 26 of boom 10 folds in an accordion-like fashion, so that the flotation section 26, having relatively rigid flotation elements, may be contracted into a tighter mass. As boom 10 is contracted, it will be observed that oil slick 22 is drawn into a much more compact mass, which is suitable for recovery by pumping or drawing oil slick 22 from within the area which is surrounded by boom 10.

With reference now to FIG. 5A, there is shown a boom incorporating the present invention, in an embodiment which is particularly suitable for capturing oil slicks or other contaminate material spills in relatively open or deep bodies of water. It will be seen that boom 10 is provided with a flotation section 28 for floating at the surface of the body of water. Flotation section 28, in the embodiment illustrated, comprises a series of float pockets 30, each of which contains flotation material 32. Each float pocket 30 is preferably separated from the next or neighboring float pockets in the raw by accordion pleats 34. Each of the accordion pleats in the embodiment illustrated is preferably approximately 8 inches wide. Accordion pleats 34 permit each float pocket, containing relatively rigid flotation material 32, to fold against the next or adjacent float pockets in the row in an accordion-like fashion, as the boom 10 is contracted.

The flotation material 32 contained in float pockets 30 may preferably be a conventional oblong fishing float. An example of such a conventional fishing float suitable for use in the boom of the present invention is a float supplied under the trademark "CASAMAR 5000" by Spongex International, #6 Bridge Street, Shelton, Conn. 06484, which is approximately 8–9 inches in diameter and about 10–11 inches long. Such conventional oblong fishing floats are readily available from suppliers of commercial fishing equipment. In the preferred embodiment of the boom shown in FIG. 5A, such floats are contained in the float pockets 30, and are spaced along flotation section 28 with their centers at approximately 2 foot intervals. The pockets containing such floats are preferably sufficiently tall so as to provide adequate freeboard above the surface of the body of water to prevent spillage of the oil slick over the top of boom 10. Such spillage may occur, not as a result of attempting to skim the slick with the boom, as with the conventional "U"-shaped booms described above, but rather from wind and wave action on the surface of the body of water surrounded by boom 10.

Attached along the base of flotation section 28 is a top line 36, which may be made of any suitable material, such as nylon line. Top line 36 has a hand loop 37 in it which extends upwardly above flotation section 28, so as to provide a convenient point for handling and securing boom 10 alongside a watercraft. Line 36 extends longitudinally past the end of flotation section 28 so as to form a tow line 38 having an eye or thimble 40 in the end thereof for attachment to a watercraft. Accordingly, when boom 10 is towed by watercraft 12, the towing force acts through tow line 38 and top line 36 along the base of floatation section 28.

Attached to and extending downwardly from a lower edge of flotation section 28 is contaminate impervious skirt section 42. In a preferred embodiment of the boom for catching oil slicks in open water, contaminate impervious skirt section 42 extends approximately 20 ft. downwardly from flotation section 28. Skirt section 42 is constructed of a contaminate imperviousment fabric or material, many varieties of which are known to those skilled in the art. A preferred contaminate imperviousment material suitable for use in the present invention is a 23 mil. plasticized fabric supplied under the trademark "NOVA-THANE" by Polymer International, Post Office Box 868, Truro, Nova Scotia, CANADA B2N-5G6. It will be understood, however, that any suitable contaminate impervious fabric or sheet material may be used for skirt section 42 without departing from the scope and spirit of the present invention. Contaminate impervious skirt section 42 runs the entire length of boom 10, so as to contain contaminate material which is confined by the boom. Along the lower edge of skirt section 42 is hem line 44, which may be made of any suitable material, such as nylon line.

Attached to hem line 44 and extending downwardly from the lower edge of skirt section 42 is net section 46. In the preferred embodiment of the invention illustrated, net section 46 preferably extends downwardly from skirt section 42 for a distance of approximately 7 feet. Net section 46 runs continuously the entire length of the lower edge of skirt section 42. Net section 46 may be constructed of any suitable netting material, inasmuch as its primary purpose is to permit the flow of subsurface water therethrough. An example of a suitable netting material for use in the embodiment of the present invention which is illustrated in FIG. 5A is a commercially available polypropylene fishing net having a 3 inch mesh.

Attached along the lower edge of net section 46 is lead line 48. Lead line 48 is a weighted line which serves to provide a ballast section for maintaining the skirt section and net section in substantially vertically orientation. Lead line 48 may be any suitable weighted line, but is preferably an enclosed lead line having a lead core. Such lead cored lead line is readily available from suppliers of commercial fishing equipment. Lead line 48 preferably has a weight of approximately 6–8 pounds per fathom of length for use in the embodiment illustrated.

Lead line 48 terminates at the edge of boom 10 in an eye 50. Similarly, hem line 44 terminates in an eye 52 at the edge of boom 10. Also running in a substantially vertical direction along the edge of boom 10 is edge line 54, which may preferably be a nylon line. Edge line 54 serves to strengthen the edge of boom 10, and provides an attachment point for a substantially vertical row of snap hooks 56. Snap hooks 56 are provided with spring loaded gates which facilitates ease of use in a marine environment. However, it will be understood by those skilled in the art that any suitable securing or hooking means, such as, for example, shackles, open hooks, fabric loops, or manually tied pieces of line, may be used as fasteners in place of the snap hooks in the practice of the present invention. Snap hooks 56 are preferably placed relatively close together (i.e., at approximately 2–3 foot spacings), so that there will not be excessive slack in edge line 54 and skirt section 42 between adjacent snap hooks 56. The use of snap hooks 56 will be described in greater detail below with reference to FIG. 5B.

A series of rings 58, which are preferably plastic rings having a 3-inch inner diameter, are attached along line 36, preferably at approximately 6 foot intervals. An upper purse line 60 is run sequentially through rings 58 with a slipping or sliding fit, so that tension applied to one end of upper purse line 60 will cause upper purse line 60 to move longitudinally through rings 58. Upper purse line 60 terminates in an eye 62 proximate the end of boom 10. Eye 62 is sized so as to prevent its passage through rings 58; furthermore upper purse line 60 terminates in another eye, as will be described below with reference to FIG. 5B, which is also sized to prevent its passage through rings 58. Eye 62 is detachably secured to an eye 64 in tow line 38 by means of shackles or chain links 66. Chain links 66 may be preferably of the split link variety so as to facilitate their expeditious detachment and attachment in a marine environment. Accordingly, it may be seen from FIG. 5A that eye 62 of upper purse line 60 may be detached from eye 64 of tow line 38, and tension may be applied to the end of upper purse line 60 at eye 62 so as to cause flotation section 28 to contract.

In a manner similar to that described with respect to the upper purse line, a second row of rings, also preferably 3 inch diameter plastic rings, is attached along hem line 44 at approximately 6 ft. intervals. A skirt purse line 70 is run with a slipping or sliding fit through the series of rings 68, so that tension on one end of skirt purse line 70 will cause skirt purse line 70 to slide longitudinally through rings 68. In a similar manner to upper purse line 60, skirt purse line 70 terminates proximate the edge of boom 10 in an eye 72. Eye 72 is connected by means of shackles or chain links 74, which may preferably be the split link type, to an eye 76 in breast line 78. Eye 76 in breast line 78 is also attached to eye 52 in hem line 44 so as to avoid inadvertently exerting tension on skirt purse line 70 when breast line 78 is under tension.

A third row of plastic rings 80 is attached along lead line 48, preferably at intervals of approximately 6 ft. As with the rings previously described, rings 80 are preferably plastic rings having an internal diameter of approximately 3 inches. The net purse line 82 is run through rings 80 in the same manner as that described above with respect to the other purse lines, so that tension applied to an end of net purse line 82 will cause net purse line 82 to slide longitudinally through rings 80. Net purse line 82 terminates in an eye 84 proximate the edge of boom 10. Which is attached to an eye 86 in breast line 78 by means of shackles or chain links 88 in the manner described above. Eye 86 in breast line 78 is also attached to eye 50 in lead line 48, so as to avoid inadvertently applying tension to the end of net purse line 48 at eye 84 when tension is applied to breast line 78.

Breast line 78, as was described above, is attached to net purse line 82 and lead line 48 at eye 86, and to skirt purse line 70 and hem line 44 at eye 76. Breast line 78 also has an upper eye 90, by which it is attached to tow line 38 at eye 92. Accordingly, breast line 78 serves to maintain the vertical orientation of skirt section 42 and net section 46 at the edge of boom 10 while boom 10 is being towed by a watercraft attached to tow line 38 in a manner as described above with reference to FIG. 2. Furthermore, breast line 78 may be used to pull eye 84 on net purse line 82, and eye 72 on skirt purse line 70, to the surface for detachment, if necessary, although other means are preferably provided for this purpose, as will be described below.

Accordingly, it will be seen from FIG. 5A that each of the purse lines—upper purse line 60, skirt purse line 70, and net purse line 82—may individually be detached from their attachment points to tow line 38 and breast line 78 and tension applied thereto. It will be observed that when such tension is applied to an end of an individual purse line, the individual purse line will slide longitudinally through its respective rings, and inasmuch as the other end of the purse line is prevented from passing through the rings, the length of the purse line which is distributed along the length of the boom will be reduced, thereby contracting the respective part of the boom to which the purse line is attached. If the boom has been deployed around a portion of the body of water in the manner shown in FIG. 3, it will be understood that the purse lines, in effect run about the circumference of the circular barrier formed by boom 10. Consequently, when tension is applied to the purse lines so as to shorten the length of the purse lines about boom 10, the circumference of the circular barrier formed by boom 10 must be reduced. In other words, flotation section 28, skirt section 42, net section 46, and/or entire boom 10, depending on the selective application of tension to the respective purse lines, contracts about the portion the body of water which is surrounded by boom 10. As noted above, this contraction of boom 10 serves to compress the contaminate material, such as oil slick 22 in FIGS. 3 and 4, into a much more compact mass for subsequent removal.

It will also be observed that continued application of tension on a selected purse line will cause the portion of boom 10 to which that purse line is attached to compress together into a very tight mass. In other words, continued application of tension on a selected purse line will cause its portion of boom 10 to compress until that portion is tightly cinched together. When either flotation section 28 or the lower edge of skirt section 42 is cinched together, the passage of liquids and solids—including the contaminate material—past the compressed portion of the boom will be effectively restricted. Thus, the technique of the present invention may be advantageously practiced in accordance with the following steps: The ends of upper purse line 60 and skirt purse line 70 may be hauled in on evenly, so as to continue to contract boom 10 as shown in FIG. 4, and thereby form a relatively compact cylinder of water having the compacted oil slick floating thereon. This even contraction may continue until the portion of the cylinder occupied by the compressed oil slick 22 reaches the point where the oil is about to spill or flow out of the lower end of skirt section 42. At this point, the application of tension to upper purse line 60 may be slowed or stopped, while skirt purse line 70 may be heaved around on to cinch the lower edge of skirt section 42 closed. Under some circumstances, particularly if the mass of the collected oil is relatively small, it may be possible to also cinch flotation section 28 closed as well. In either case, the entire boom can then be removed from the body of water together with the enclosed contaminate material. The contaminate material may then be disposed of, as by dumping into a holding tank, and the boom may be redeployed as described above for additional cleanup action.

In addition to flotation section 28 and the lower edge of skirt section 42, the lower edge of net section 46 can also be selectively cinched closed in the manner described above, for the purposes described below with reference to FIG. 9.

Figure 5B:
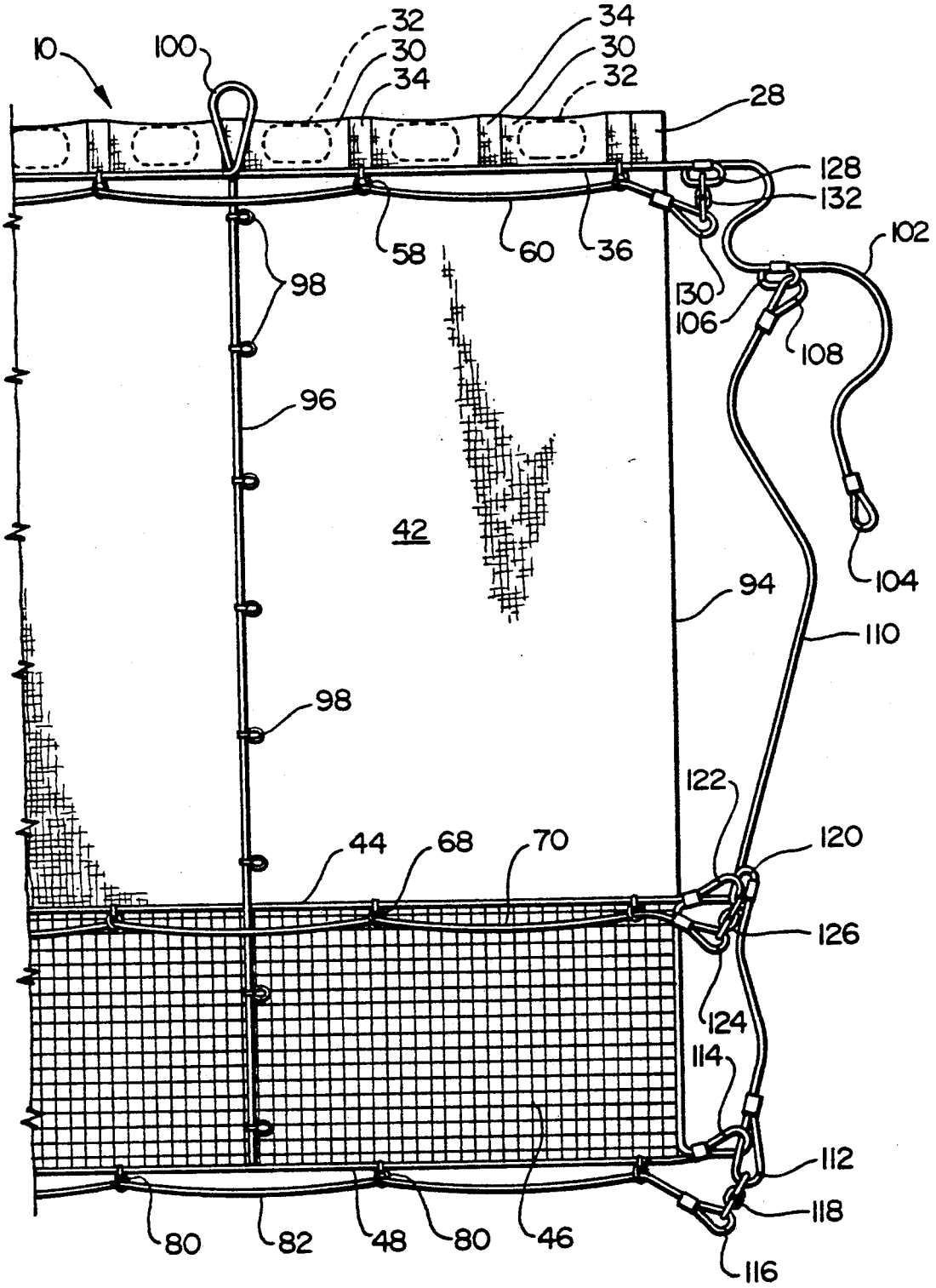
FIG. 5B is a side elevational view of a second end of the boom of FIG. 5A.

With reference now to FIG. 5B, the features of boom 10 on the end of boom 10 opposite that described with reference to FIG. 5A will be described. With reference to FIG. 5B, there is shown the opposite end of flotation section 28, having float pockets 30 containing flotation material 32, and having accordion pleats 34. Top line 36 is seen at the lower edge of flotation section 28, and skirt section 42 extends downwardly from flotation section 28. Hem line 44 is attached along a lower edge of skirt section 42, and net section 46 extends downwardly from skirt section 42 to lead line 48 attached along the lower edge of net section 46. Upper purse line 60 runs through rings 58 along the base of flotation section 28, skirts purse line 70 runs through rings 68 along hem line 44, and net purse line 82 runs through rings 80 along lead line 48, all in the manner described above. The end of boom 10 illustrated in FIG. 5B has an edge 94. Set back a predetermined distance from edge 94 is a substantially vertical snap line 96. Snap line 96 is preferably set back approximately 10 feet from edge 94, and preferably runs vertically across boom 10 from the flotation section 28 to lead line 48. At selected intervals along snap line 96 are attached rings 98. Rings 98 are positioned at intervals which correspond to the vertical intervals between snap hooks 56 on the other end of boom 10. Rings 98 may be of any suitable form and material selected to be engaged by snap hooks 56, or by any alternative fasteners, and are preferably 3 inch plastic rings in the embodiment illustrated. Accordingly, when the first and second ends of boom 10 are overlapped, preferably by a distance of approximately 10 feet, snap hooks 56 and rings 98 will be adjacent to each other so that they can be secured to one another. A hand loop 100 is most preferably provided above the flotation section at the upper terminus of snap line 96, to assist in withdrawing rings 98 and snap hooks 56 from the body of water so that they can be engaged sequentially (i.e., the first snap hook 56 and ring 98 may be engaged, hand loop 100 may be lifted to as to expose the next snap hook and ring for engagement, and so forth). Furthermore, the eyes at the end of the purse lines may be brought to the surface in this manner, for detachment and subsequent tensioning of the purse lines.

As noted above, snap hooks 56, and consequently rings 98, are preferably spaced so as to avoid excessive slack areas between them. Thus, when the first and second ends of boom 10 are overlapped and secured together in the manner described, a relatively tight fit will be achieved, particularly when the contraction of the boom 10 commences, which will prevent the escape of the contaminate material from a portion of the body of water which is surrounded or encircled by boom 10.

With further reference to FIG. 5B, it will be seen that line 36, extends outwardly from edge 94 of boom 10 to form a tow line 102 having an eye or thimble 104 in the end thereof. Eye 104 may be attached to an watercraft, or to a sea anchor if the end of boom 10 which is shown is FIG. 5B is the end which is initially deployed in the manner shown in FIG. 1. Tow line 102 also has an eye 106 to which is attached an eye 108 of breast line 110. Breast line 110 has a lower eye 112 which is connected to eye 114 of lead line 48, and to eye 116 of net purse line 82 by means of shackles or chainlinks. Breast line 110 also has a middle eye 120 which is connected to eye 122 on hem line 44, and to eye 124 on skirt purse line 70 by means of shackles or chainlinks 126. Accordingly, breast line 110 serves an equivalent purpose with respect to the end of boom 10 shown in FIG. 5B as does breast line 78 with respect to the end of boom 10 which is shown in FIG. 5A. Tow line 102 also has an eye 128 which is connected to eye 130 on upper purse line 60 by means of shackles or chainlinks 132.

Accordingly, it will be observed that, with the exception of the vertical row of rings 98 along snap line 96, the end of boom 10 which is shown if FIG. 5B is, in essence, a mirror image of the end of boom 10 which is shown in FIG. 5A. Thus, it will be understood that the eyes on the ends of the purse lines shown in FIG. 5B may be detached from their connections and tension applied thereto so as to contract boom 10. Preferably, tension is applied by heaving in on both the ends of the purse lines shown in FIG. 5B and the ends of the purse lines shown in FIG. 5A simultaneously.

Figure 6:
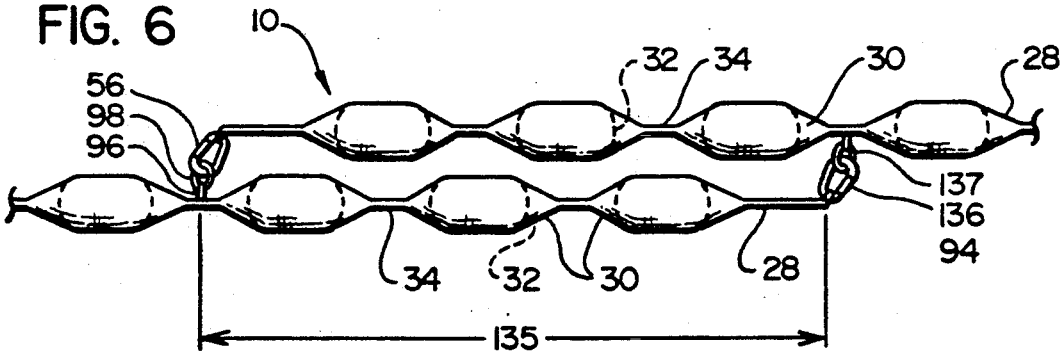
FIG. 6 is an overhead plan view of the overlapped portions of the boom shown in FIG. 3.

With reference now to FIG. 6, additional details of the overlapped portion of the boom 10 shown in FIG. 3 will be described. With reference to FIG. 6, there is shown an overhead view of the overlapped section of boom 10. Flotation section 28 of boom 10 is visible, having float pockets 30 containing flotation material 32 arranged so that the float pockets are separated by accordion pleats 34. The initially deployed, or trailing, edge 94 of boom 10, which corresponds to the edge shown first deployed in FIG. 1, may also be seen. The other end of boom 10, which has the leading edge having snap hooks attached thereto, is overlapped against the first end of boom 10 by a distance 135. As noted above, distance 135 is approximately 10 feet. It will be observed that snap hooks 56 are engaged with rings 98. Rings 98, in turn, are attached to boom 10 along snap line 46. Thus it will be seen that the overlapped portions of boom 10 fit relatively tightly together so as to prevent the escape of the contained contaminate material. As a further refinement, an additional snap hook 136 may preferably be attached to flotation section 28 at edge 94, and a corresponding ring may be attached to flotation section 28 at a point which is set back from the leading edge of boom 10 by distance 135, so that edge 94 can be tightly secured to the portion of boom 10 against which it overlaps by engaging ring 137 with snap hook 136.

Figure 7:
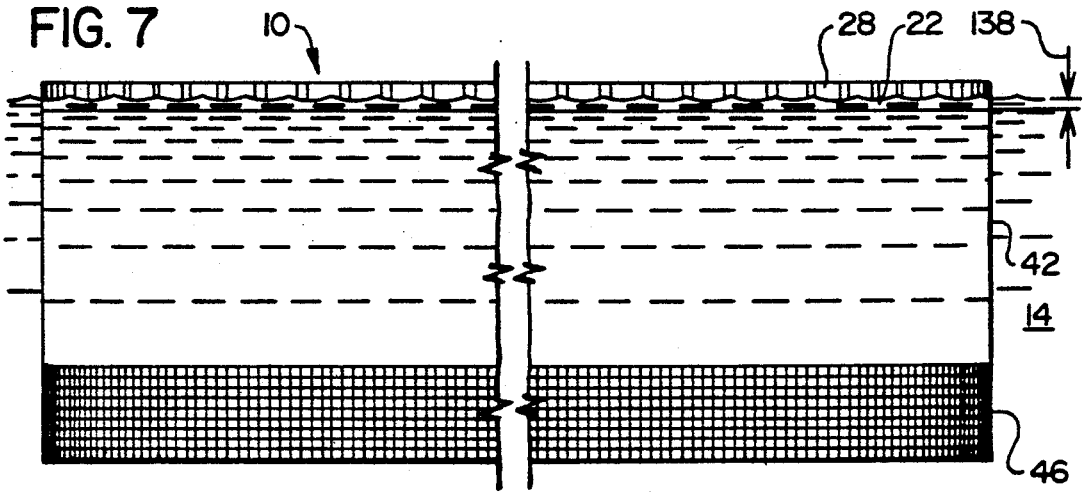
FIG. 7 is a schematic section view taken across the diameter of the boom shown in FIG. 3.
Figure 8:
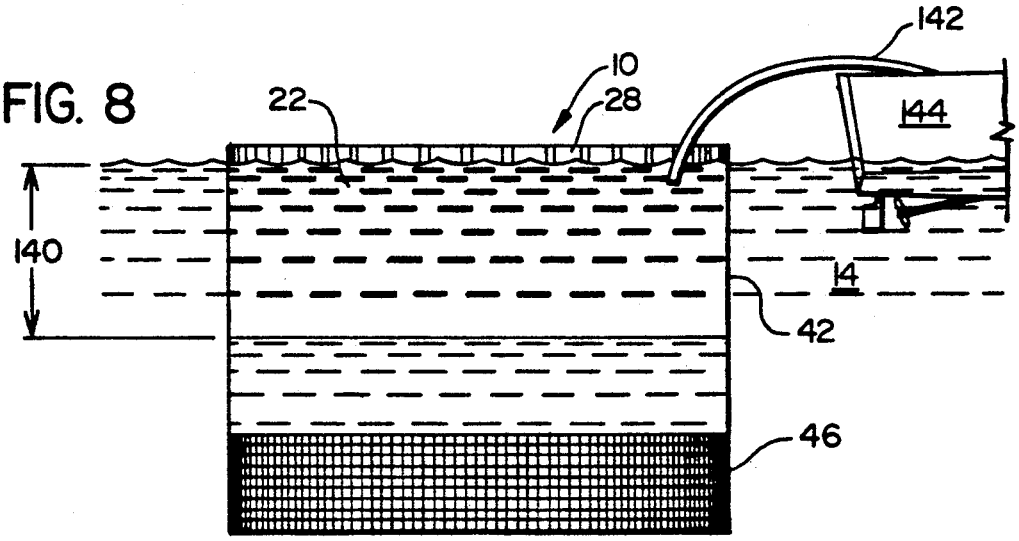
FIG. 8 is a schematic section view taken across the diameter of the boom shown in FIG. 4.

With reference now to FIGS. 7 and 8, the contraction of boom 10 as shown in FIGS. 3 and 4 will be described in greater detail. FIG. 7 is a schematic section view taken from FIG. 3 along line 7—7. In this view, where the purse lines have yet to be tensioned, it will be seen that boom 10 surrounds a portion of body of water 14 in a completely extended condition. Flotation section 28 is at the surface of the body of water and is not folded. Skirt section 42 extends downwardly from float section 28, and net section 46 extends downwardly from skirt section 42. In this condition, it will be seen that the contaminate material, oil slick 22, is thinly spread across the large surface area of body of water 14 which is surrounded by boom 10. Oil slick 22 is, consequently, very thin, as indicated by thickness 138. With reference now to FIG. 8, however, it can be seen that boom 10 in its contracted state has greatly reduced the surface area of the portion of body of water 14 which is surrounded by boom 10, and consequently the thickness of oil slick 22, as indicated by thickness 140, has become much greater. Accordingly, oil slick 22 has been compressed into a much more compact mass, which is suitable for collection and removal from body of water 14, as, for example, by means of a suction line 142 through which oil slick 22 is drawn and collected within a holding tank on a skimmer boat 144.

Figure 9:
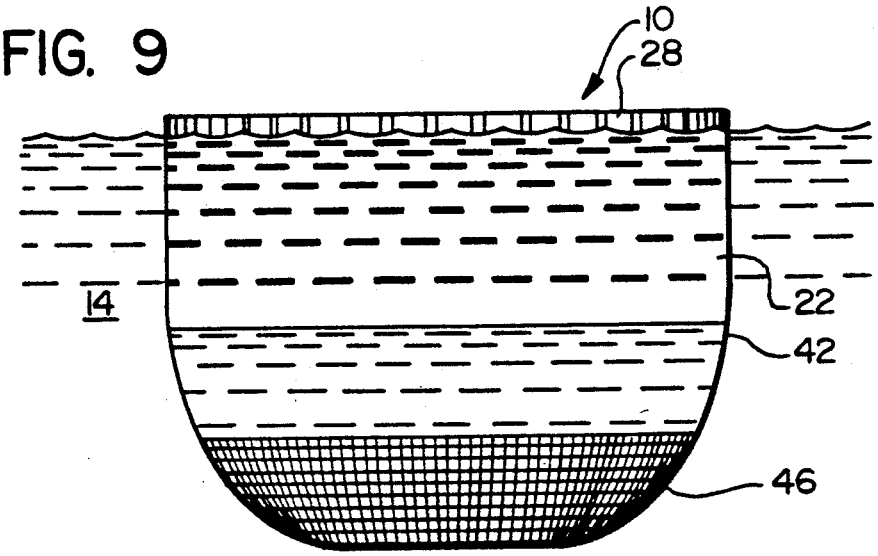
FIG. 9 is a schematic section view of a boom in accordance with the present invention, showing contraction of the net section thereof.

With reference now to FIG. 9, there is shown a schematic section view of a boom in accordance with the present invention, wherein the net section of the boom is contracted to a greater extent than the skirt and flotation section thereof. It will be seen that there is a boom 10, having a flotation section 28, skirt section 42, and net section 46, which, in the manner shown in FIG. 3, have encircled a portion of body of water 14 having an oil slick 22 thereon. It will be seen that net section 46 has been contracted to a greater extent than the remaining sections of boom 10, by applying tension to an end of the net purse line so as to draw the lower edge of net section 46 together. This technique imparts an increased degree of controllability to boom 10, the lower edge of which may otherwise sway or flop about undesirably as the upper portion of the boom rises and falls in a seaway. It will be a observed that, in this configuration, net section 46 permits the flow therethrough of subsurface water as the boom rises, falls, and is distorted by the action of the swells, so as to relieve pressure on the boom 10 and avoid spillage over the top thereof.

The technique shown in FIG. 9 may also be particularly advantageous to dredge up or capture tar balls or other solid contaminate material which may have sunk to the bottom of body of water 14, or may be suspended in the water column below compacted oil slick 22. Hence, if the boom 10 is deployed so as to surround a portion of a shallow body of water 14 wherein the bottom of net section 46 (i.e., the lead line and net purse line) is in contact with the floor of body of water 14, the lower edge of net section 46 will drag along the bottom of body of water 14 and dredge up such sunken or suspended materials when the net purse line is tensioned. The lower edge of net section 46 can then be cinched closed to retain the dredged up materials. It has been observed that many sunken tar balls exhibit near-neutral buoyancy in sea water; accordingly, they are readily stirred or kicked up from the bottom and collected by this technique. During subsequent contraction of the skirt and flotation sections, as described above, net section 46 will permit the necessary release or flow of subsurface water therethrough, while retaining the solid contaminate materials which it has dredged up or collected.

As noted above, tar balls represent one form of contaminate material which may sink to the bottom of or be suspended in a column of water of body of water 14. Such tar balls frequently form as the result of weathering of an oil slick, particularly after the lighter and more volatile components of the oil slick have evaporated off. The tar balls which result from such weathering are typically relatively dense, and may pick up heavy or waterlogged material from the shoreline of the body of water. Consequently the tar balls may sink to the bottom of the body of water, or may subside below the surface of the body of water and become suspended in the water column. Accordingly, it will be understood that if the boom of the present invention is used to capture such an oil slick when it is in the later stages of weathering, or if the boom is used to retain or store a captured oil slick for a period of time until recovery equipment becomes available to remove the slick, during which time significant weathering occurs, then tar balls may form and sink downwardly from the oil slick which is surrounded by the boom.

Figure 10:
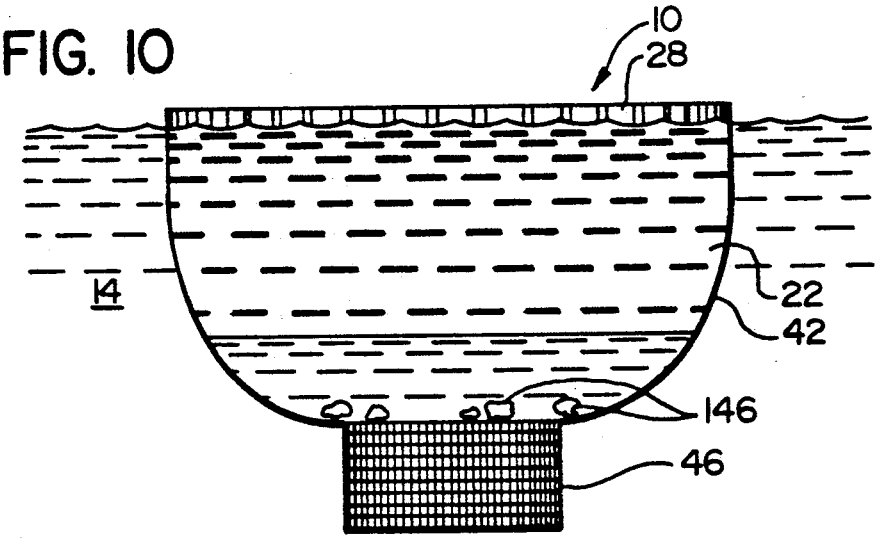
FIG. 10 is a schematic section view of a boom in accordance with the present invention, showing the lower edge of the skirt section cinched closed.

In order to retain large tar balls and other solid contaminate material which may be sinking from an oil slick which is retained or stored by a boom in accordance with the present invention, it may be desirable to cinch the lower edge of the net section closed during such retainment or storage period. Alternatively, it may be desirable to cinch the lower edge of the skirt section closed to prevent the escape of finer particles of the contaminate material which may be sinking from the contained oil slick. With reference to FIG. 10, there is shown a boom 10 in accordance with the present invention, which has been deployed so as to surround a portion of body of water 14, in the manner described above with reference to FIGS. 1 through 4. Boom 10 has a flotation section 28, a skirt section 42, and a net section 46. A compacted oil spill 22 is retained by boom 10, and, in this case, has been subjected to considerable weathering so as to cause the formation of tar balls.

With further reference to FIG. 10, it will be seen that the lower edge of skirt section 42 has been cinched closed, preferably by applying tension to the skirt purse line in the manner described above. The lower edge of skirt section 42 may preferably be cinched closed after the lower edge of net section 46 has been cinched closed, in the manner described above with reference to FIG. 9. With reference to FIG. 10, it will be seen that tar balls 146, which might otherwise sink to the bottom of body of water 14, are captured and retained within skirt section 42. Furthermore, with skirt section 42 cinched closed, finer solid materials, as well as colloidal or emulsified materials which may result from agitation of the contaminate materials and water, will be retained by the contaminate impervious material of skirt section 42. Thus, the contaminate materials may be stored for an indefinite period of time in boom 10 in the manner shown in FIG. 10, until a collection craft becomes available to remove the materials from body of water 14.

Figure 11A:
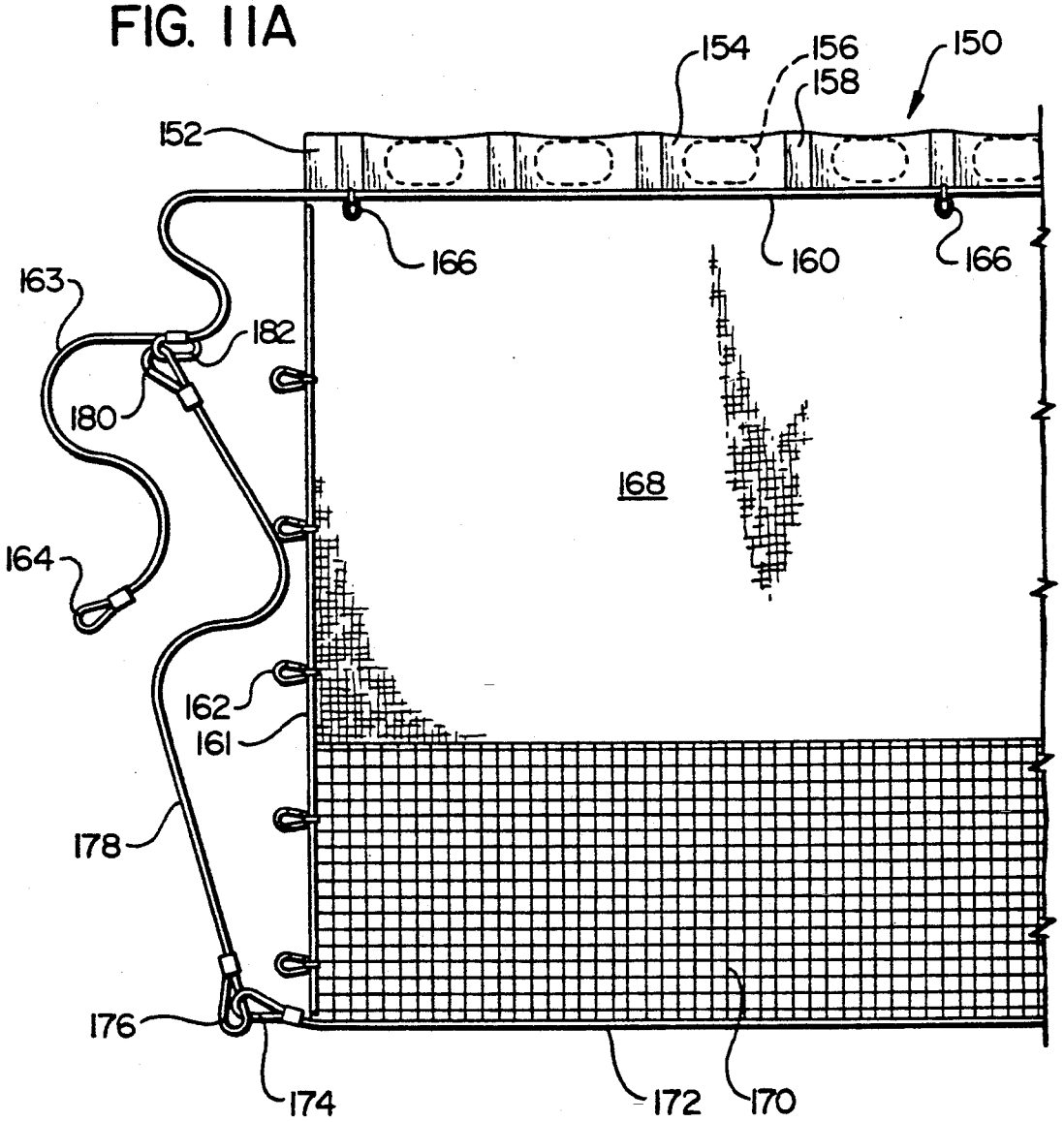
FIG. 11A is a side elevational view of a first end of a boom in accordance with the present invention which is adapted to capture a contaminate spill in a relatively shallow water area and remain anchored to the bottom of the body of water.

With reference now to FIG. 11A, an embodiment of the boom of the present invention which is adapted to rest on and be substantially fixed to the floor or bottom of a body of water will be described. With reference to FIG. 11A, there is shown a boom 150. Boom 150 has a flotation section 152, which, in the manner described above with reference to FIG. 5A, preferably comprises a horizontal row of float pockets 154 having flotation material 156 enclosed therein, each such flotation pocket being spaced apart from its neighbors by a accordion pleat 158. The float pockets 154 and accordion pleats 158 are preferably constructed of the NOVATHANE material described above, and preferably have similar dimensions to those which were described above with respect to flotation section 28 in FIG. 5A. Similarly, flotation material 156 preferably comprises conventional fishing floats, such as the CASAMAR 5000 described above.

Along the base of flotation section 152 is a top line 160, which is preferably a nylon line. Top line 160 extends outwardly from edge line 161 of boom 150, so as to form a tow line 163. Tow line 163 has an eye or thimble 164 at the end thereof, so that tow line 163 may be attached to a mobile watercraft. At preselected intervals along top line 160 are attached rings 166. Rings 166 are preferably similar to the 3" diameter plastic rings described above with reference to FIGS. 5A and 5B, however, in the embodiment illustrated in FIG. 11A, in the spacing between the rings is preferably approximately 20 feet. Rings 166 in the embodiment of the present invention which is shown in FIG. 11A are not provided as slidable or slippable connection points for a purse line as described above. Rather, rings 166 provide attachment points for additional anchoring means, as will be described below with reference to FIG. 12.

Edge line 161, in substantially the same manner as edge line 54 shown in FIG. 1, serves to strengthen the edge of boom 150 and provides an attachment point for a substantially vertical row of snap hooks 162. The construction and use of snap hooks 162 are substantially the same as were described above with reference to snap hooks 56 shown in FIG. 1.

With further reference to FIG. 11A, there is shown a contaminate impervious skirt section 168 which extends downwardly from flotation section 152. Skirt section 168 is preferably constructed of the 23 mil plasticized material previously described, and preferably extends downwardly from flotation section 152 a sufficient distance so that the lower edge of skirt section 168 will be proximate (e.g., within a few feet of) the floor or bottom of the body of water in which the deployment of boom 150 is planned. For all around use in shallow water areas, including rivers, estuaries, small harbors, and shorelines, skirt section 168 may most preferably extend approximately 12 feet downwardly from flotation section 152.

A mesh net section 170 extends downwardly from skirt section 168. Net section 170 is preferably constructed of the 3-inch mesh netting material described above. Net section 170 preferably extends downwardly from skirt section 168 a sufficient distance so that the lower edge of net section 170 will contact the floor of the body of water in which deployment of boom 150 is planned, and most preferably extends approximately 7 feet downwardly from the lower edge of skirt section 168. Net section 170 serves to permit the release or flow of subsurface water therethrough, particularly the flow therethrough of moving water resulting from tidal and current forces, as will be described in greater detail below.

Along the lower edge of net section 170 is attached lead line 172. Lead line 172 is preferably a lead-cored lead line of the type described above, and most preferably has a weight of approximately 10–12 pounds per fathom; accordingly, lead line 172 will be substantially heavier than the lead line used in most floating catcher embodiments of the boom of the present invention, such as was described above with reference to FIGS. 5A and 5B. It will be understood that the flotation section 152 of boom 150 will not be required to support the heavier weight of lead line 172 when deployed, since lead line 172 will rest on the floor of the body of water.

With further reference to FIG. 11A it will be seen that lead line 172 extends outwardly from edge 161 of boom 150 and terminates in an eye 174. Eye 174 is attached to corresponding eye 176 in breast line 178. Breast line 178 has an upper eye 180 which is attached to an eye 182 in tow line 162. Thus it will be seen that breast line 178 serves, in a similar manner to the breast line described above with reference to FIG. 5A, to maintain the vertical orientation of the edge 161 during deployment and manipulation of boom 150 by a moving water craft attached to tow line 162. Breast line 178 also serves to assist in lifting lead line 172 out of contact with the bottom of the body of water during recovery of the boom 150.

Figure 11B:
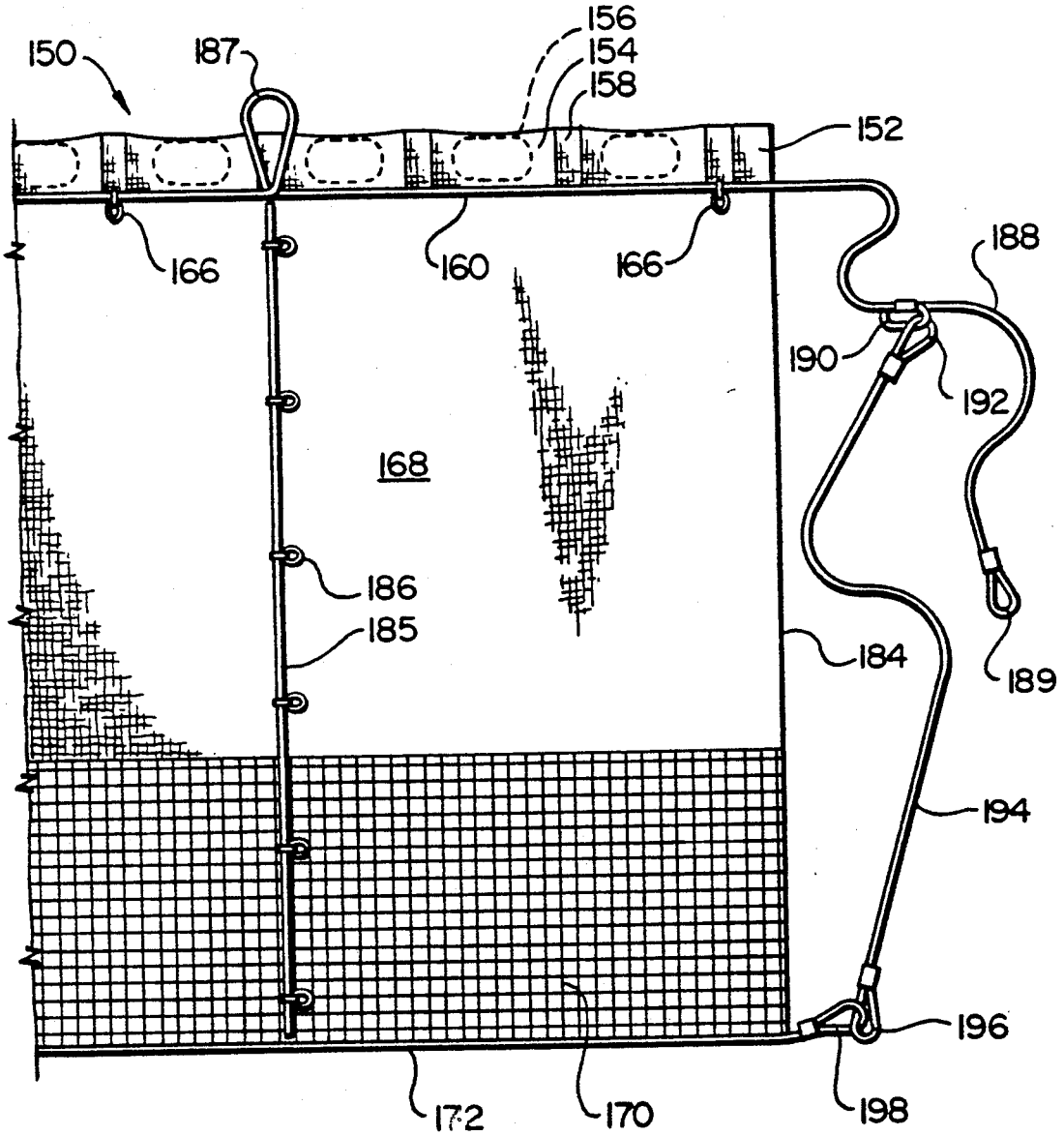
FIG. 11B is a side elevational view of a second end of the boom of FIG. 11A.

With reference now to FIG. 11B, the opposite end of boom 150 from that shown in FIG. 11A will be described. It will be seen that the end of boom 150 shown in FIG. 11B has a flotation section 152, which includes flotation pockets 154, flotation material 156, and accordion pleats 158, arranged in the manner described above. Boom 150, at this end, also includes a top line 160 having rings 166 attached thereto, preferably at 20-foot intervals, and a skirt section 168 extending downwardly from rotation section 152. Net section 170 extends downwardly from skirt section 168, and has lead line 172 attached along the lower edge thereof.

The end of boom 150 shown in FIG. 11B has an edge 184. Set back a predetermined distance from edge 184 is a substantially vertical snap line 185. Snap line 185 is preferably set back approximately 10 feet from edge 184, and provides, in substantially the same manner as was described with reference to snap line 96 shown in FIG. 5B, an attachment point for a substantially vertical row of rings 186. Rings 186 are positioned at intervals which correspond to the vertical intervals between snap hooks 162, and are adapted to be engaged thereby. Accordingly, when an end of boom 150 having snap hooks 162 attached thereto is overlapped against an end having rings 186 attached thereto, the overlapped ends may be secured to one another in the manner described above. A hand loop 187 is preferably provided at the upper terminus of snap line 185 to assist in securing the ends together.

Top line 160 extends beyond edge 184 of boom 150 to form tow line 188 having an eye or thimble 189 in the end thereof suitable for attachment to a towing watercraft. Tow line 18 is also provided with an eye 190, to which is attached an upper eye 192 of a breast line 194. Breast line 194 also has a lower eye 196, which attaches to an eye 198 in the end of lead line 172. Accordingly, it will be observed that, with the exception of the row of rings 186, the end of the fixed boom 150 which is shown in FIG. 11B is, in essence, a mirror image of the end shown in FIG. 11A. Accordingly, boom 150 may be deployed by a single craft attached to either end of boom 150.

With further reference to FIGS. 11A and 11B, a preferred manner of deploying boom 150 will be described. Either end of boom 150 may be placed in the body of water so that the lead line at the bottom edge of that end of boom 150 comes into contact with the floor of the body of water, thereby anchoring that end of boom 150 in a substantially stationary or fixed position relative to the floor of the body of water. The remaining portion of the boom 150 may then be paid out over the stern of a moving watercraft, much in the manner described above with reference to the deployment of the boom shown in FIG. 1, while moving the watercraft so as to segregate a desired portion of the body of water with the boom. Each sequential portion of boom 150 which is paid out will remain in a relatively fixed location with respect to the bottom of the body of water, inasmuch as its corresponding portion of lead line 172 will come into contact with the bottom so as to anchor that portion of the boom 150 thereto. Hence, it is very easy and efficient to deploy boom 150 from a single moving watercraft. The watercraft may be maneuvered to deploy the final portion of boom 150 so that the skirt sections of the two ends of a single boom 150 overlap one another, so as to surround the portion of the body of water 150 with the boom 150. These overlapping skirt sections may then be secured together so as to prevent the escape of contaminate material, such as an oil slick, from the portion of the body of water which is surrounded by the boom.

Inasmuch as the fixed, or bottom founded, embodiment of the boom of the present invention is particularly well suited for use in shallow waters which are subject to tidal and current forces, additional anchoring means may be attached to boom 150 at rings 166 so as to help maintain the deployed boom in a substantially fixed position.

Figure 12:
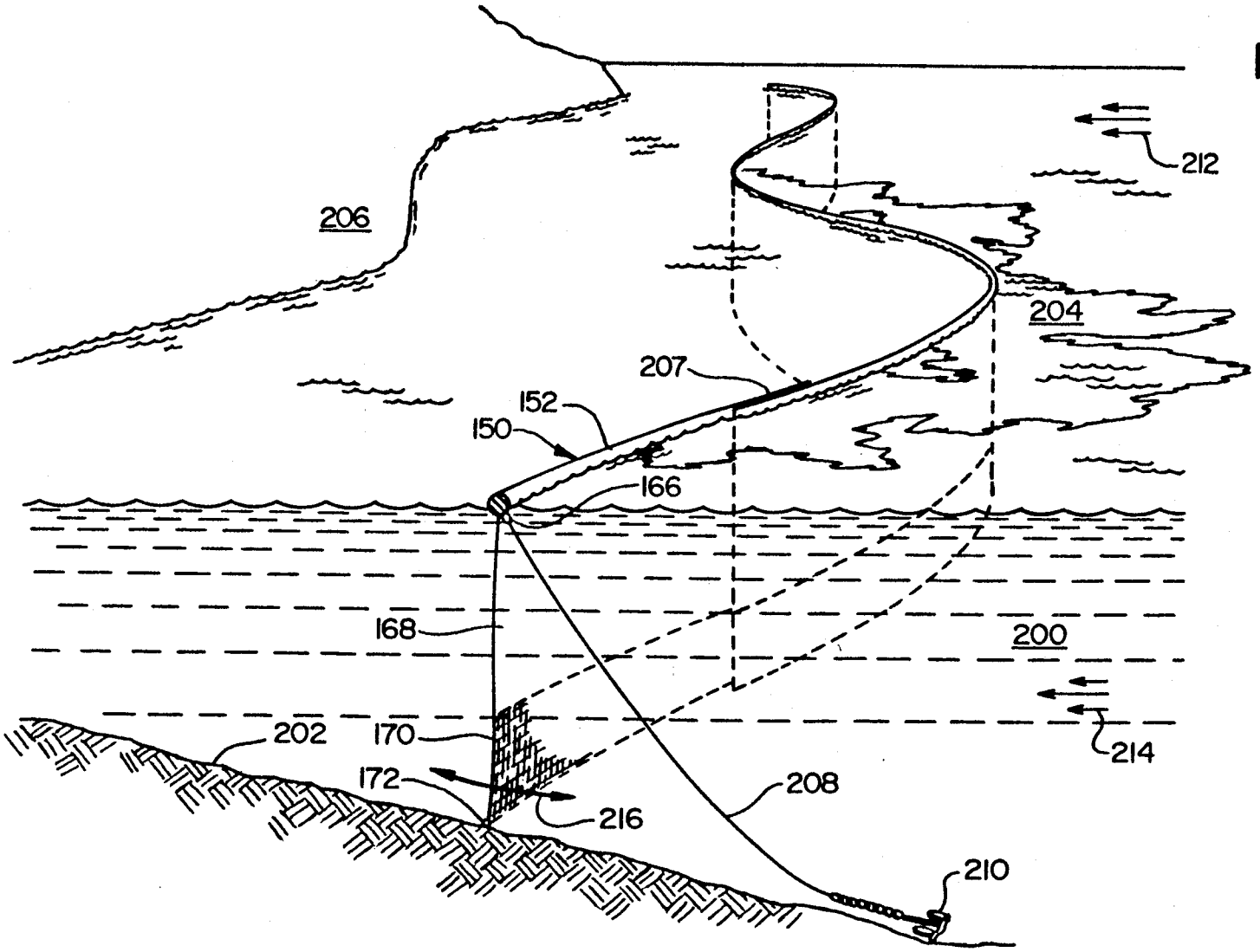
FIG. 12 is a perspective view of the boom of FIGS. 11A and 11B as deployed in a shallow water area.

With reference now to FIG. 12, there is shown boom 150 deployed in a body of water 200 having a floor 202 which is formed of substantially solid material. Boom 150 has a flotation section 152, a skirt section 168 extending downwardly from flotation section 152, a net section 170 extending downwardly from skirt section 168, and a lead line 172 attached along the lower edge of net section 170. Rings 166 are attached to boom 150 proximate a lower edge of flotation section 152. Body of water 200 has contaminate material, in the form of oil slick 204, floating thereon.

Boom 150 may be deployed so as to confine the contaminate material, such as the oil slick, by completely surrounding or encircling it in a manner similar to that described above. In the scenario shown in FIG. 12, however, boom 150 has been deployed in a fence-like manner so as to confine oil slick 204, not by completely encircling it, but rather by confining oil slick 204 to open water areas and thus deflecting the impact of oil slick 204 away from shoreline 206. In the scenario shown in FIG. 12, oil slick 204 has already dispersed upon the surface of body of water 200 and it is desired to prevent oil slick 204 from coming into contact with and soiling shoreline 206. It should be noted at this point, however, that boom 150 may also be deployed in a similar fence-like manner so as to prevent an oil spill from moving out of a relatively confined area, such as a bay or river, and out to sea, where it would disperse and become extremely difficult to recover.

With further reference to FIG. 12, it may be seen that boom 150 has been deployed along a path which is generally parallel to shoreline 206, so that lead line 172 rests on the relatively shallow floor 202 of body of water 200, thereby anchoring boom 150 in the desired position. Accordingly, boom 150 forms a fence-like barrier which deflects oil slick 204 from moving onto shoreline 206. In this arrangement, oil slick 204 moves along the fence-like barrier and is carried away from shoreline 206. Since oil slick 204 may be widely dispersed, and the area of shoreline 206 to be protected may be fairly extensive, it will be understood that a very long fence-like barrier may be needed. Each individual boom 150 is preferably about 1200–1500 feet long. If a fence-like barrier is needed which is longer than that which can be provided by one individual boom 150, a series of booms 150 may be deployed along a line which is generally parallel to the shoreline, and their ends can be overlapped and secured together in the manner previously described, so as to prevent the escape of the oil slick between the ends of the individual booms. Accordingly, with reference to FIG. 12, it will be seen that the ends of individual boom 150 are overlapped against one another at point 207, and secured together, so as to form a very long fence-like barrier which confines oil slick 204 to open water areas and deflects it away from a lengthy stretch of shoreline 206.

When boom 150 is deployed in a shallow water area near shore, as shown in FIG. 12, it will likely be subject to natural forces such as tides, currents, and winds having a tendency to move boom 150 from its substantially fixed position. Such forces are illustrated in FIG. 12 as prevailing wind forces moving in the direction shown by arrows 212, and prevailing current forces moving in the direction shown by arrows 214, which would tend to drive boom 150 on shore. To supplement the anchoring force provided by lead line 172 and thus provide additional resistance to these forces, additional anchoring means may be attached to boom 150. In the preferred embodiment illustrated in FIG. 12, an anchor cable 208 is attached to boom 150 at a ring 166. Anchor cable 208 leads to additional anchoring means, in this case a conventional bottom founded anchor 210. As is known to those skilled in the art, sufficient anchor cable 208 should be used to provide adequate catenary to render bottom founded anchor 210 effective.

In general, it would be preferable to locate the additional anchoring means on the upstream side of boom 150, towards the prevailing wind and current forces. Accordingly, the additional anchoring means comprising anchor 210 and anchor cable 208 are shown attached to the seaward side of boom 150 in FIG. 12, towards the prevailing forces moving in the directions shown by arrows 212 and 214. It would be obvious to also locate such additional anchoring means on other side of the boom, if needed to resist forces moving in different or changing directions. It will be further understood that such anchoring techniques would be equally applicable to bottom founded booms in accordance with the present invention which are deployed as to encircle contaminate material, as well as to those which are deployed in a fence-like manner, as shown in FIG. 12.

With further reference to FIG. 12, it will be seen that net section 170 forms a permeable zone between the lower edge of skirt section 168 and bottom 202. This permeable zone is effective in permitting the flow of subsurface water therethrough, particularly, in the embodiment shown, the flow therethrough of water moving with the current forces in the direction shown by arrows 214. Similarly, water moving inwardly and outwardly with tidal forces over bottom 202 will pass inwardly and outwardly through net section 170 in the directions indicated by arrows 216. Inasmuch as the contaminate material of oil slick 204 is buoyant, however, it remains floating at the surface and is not pulled under skirt section 168 and through net section 170. Accordingly, the contaminate impervious barrier formed by flotation section 152 and skirt section 168 of boom 150 are permitted to remain fixed with respect to the bottom 202, while the water moved by tidal and current forces flows under these sections and through net section 170. It would be very difficult for a flexible, floating boom to remain in a fixed position relative to the bottom of the body of water if such boom dammed up, or otherwise had to resist, the full force of such moving water.

Figure 13:
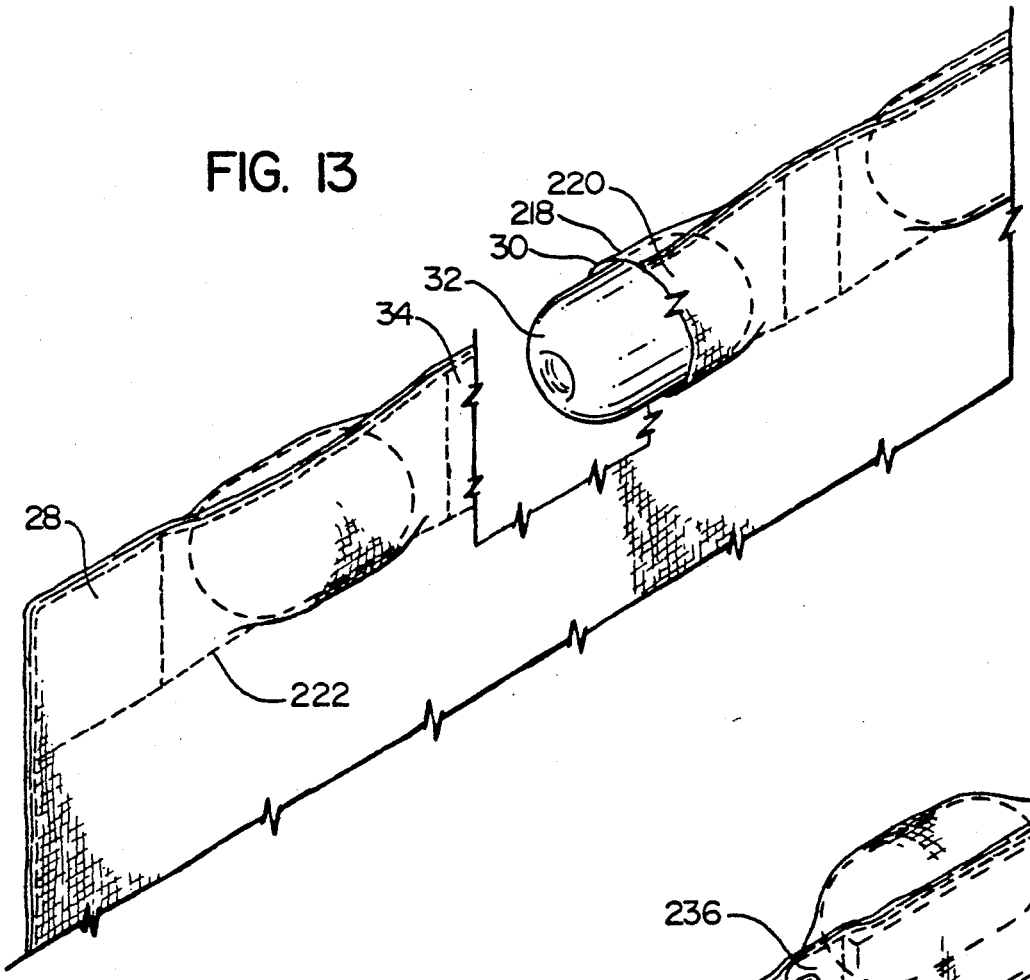
FIG. 13 is a perspective view of a portion of a flotation section of a boom in accordance with the present invention.

With reference now to FIG. 13, a preferred embodiment of a floatation section for use in the boom of the present invention, such as that shown in FIGS. 5A and 5B, will be described in greater detail. With reference to FIG. 13, there is shown a flotation section 28, which comprises a substantially horizontal row of float pockets having flotation material therein, each such float pocket being separated from the neighboring float pockets on either side thereof by an accordion pleat 34. As described above, this arrangement permits the float pockets to fold against one another when the flotation section of the boom is contracted.

With further reference to FIG. 13, it will be seen that flotation section 28 is constructed of two sheets 218 and 220 of fabric, preferably the 23 ml plasticized fabric described above, which are sewn together by stitching 222. In order to form a float pocket 30, sufficient fabric is incorporated between the rows of stitching 222 to form a cavity or pocket 30 in which a float 32 of a selected size may be enclosed. As noted above, such a suitable float may be a conventional fishing float, and may be preferably be approximately 9 inches in diameter and have a length of approximately 10–11 inches. The accordion pleats 34 between the float pockets are preferably formed by simply stitching fabric sheets 218 and 220 together to form a flat section which folds easily with little resistance. If desired, accordion pleat 34 may be pressed or creased so as to ensure that each accordion pleat 34 folds in the correct direction for float pockets 30 to fold against one another. For example, it is preferable that a first accordion pleat fold in a first lateral direction with respect to flotation section 28 while the next accordion pleat folds in the opposite lateral direction with respect to flotation section 28, so that the float pockets neatly fold against one another in a zig-zag or accordion-like pattern.

Figure 14:
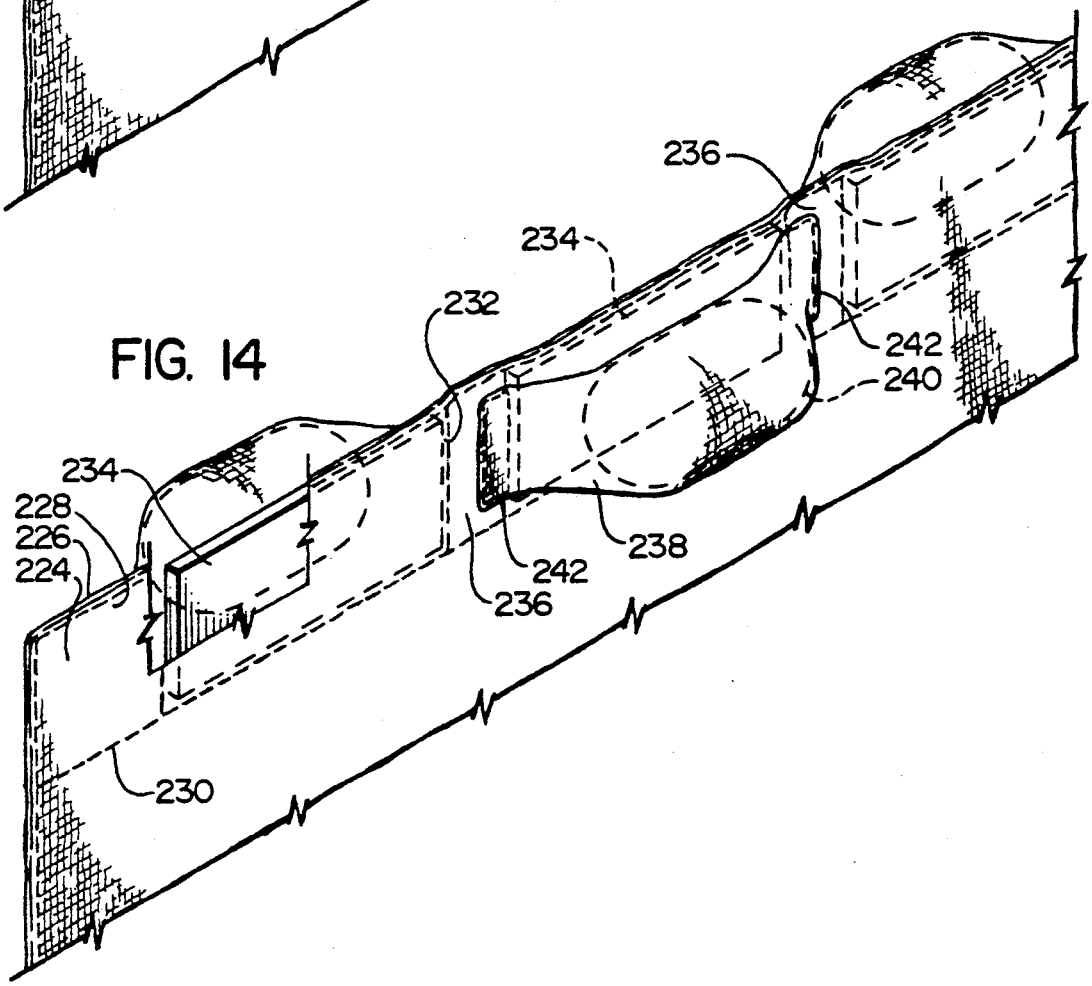
FIG. 14 is a perspective view of a portion of another embodiment of a flotation section of a boom in accordance with the present invention.

With reference now to FIG. 14, there is shown another embodiment of a flotation section which is suitable for use in the boom of the present invention. Flotation section 224, in a similar manner to that described above with reference to FIG. 13, is constructed of two sheets of material 226 and 228, which are preferably sheets of the 23 mil plasticized material, which are sewn together with stitching 230. Float pockets 232 are formed so as to include flotation material 234. In the preferred embodiment shown in FIG. 14, the flotation material 234 consists of rectangular slabs of flotation material, which material may preferably be a closed cell foam which resists breaking and crumbling in the course of deploying and recovering the boom. The closed cell foam slabs may preferably be approximately 1 inch thick and may be any suitable length and width, for example 18 inches long by 18 inches wide. The width, or height, of the slabs of closed cell foam is preferably selected so as to form a floating barrier having an extended freeboard above the surface of the body of water. This extended freeboard helps resist the spillage of contaminate material, such as an oil slick, over the top of the flotation section under the influence of wind and wave action. Each flotation pocket containing a slab of closed cell foam is separated from its neighboring flotation pockets in the flotation section 224 by accordion pleats 236, in the manner described above. In order to provide additional flotation and support, so as to maintain float pockets 232 and foam slabs 234 in a substantially upright orientation, additional float pockets 238 are incorporated along the sides of flotation section 224. Additional flotation pockets 238 are formed of fabric, such as the 23 mil plasticized fabric, in a suitable manner such as that described above, so as to contain a float 240, which is preferably a conventional fishing float, also described above. Additional float pockets 238 have ends or pads 242 which are preferably stitched onto accordion pleats 236 on either side of flotation pockets 232, so as to position floats 240 along side of foam slabs 234. The additional float pockets 232 are preferably attached so that floats 240 are positioned along side of foam slabs 234 on alternating sides of flotation section 234.

It is to be recognized that these and various other modifications could be made to the illustrative embodiments without departing from the spirit and scope of the present invention. Accordingly, the invention is not to be limited except as by the appended claims.

What is claimed and described to be secured by Letters Patent of the United States is:

1. A horizontally elongate floating boom for confining contaminate material floating on the surface of a portion of a body of water, said boom comprising:

a flotation section for floating on said surface of said body of water;

a substantially vertical contaminate impervious skirt section extending downwardly from said flotation section for retaining said contaminate material, said skirt section having first and second ends which are adapted to overlap one another and which have edges which extend downwardly from said surface;

a substantially vertical net section extending downwardly from said skirt section for permitting the flow of subsurface water therethrough;

a ballast section attached along a lower edge of said net section for maintaining said skirt section and said net section in substantially vertical orientation; and means for securing a said first end of a said skirt section and a said second end of a said skirt section together when said first and second ends are overlapped, said securing means comprising a first row of mechanical connectors extending downwardly across said skirt section proximate said first end of said skirt section and a second row of mechanical connectors configured to be engaged by said first row of connectors and extending downwardly across said skirt section proximate said second end of a said skirt section, said second row of connectors being spaced apart from said second end of said skirt section so as to form a flap portion of said skirt section which is substantially free of any additional vertically extending row of means for securing said second end of said skirt section to said first end of said skirt section, said flap portion having sufficient length that the overlap of said first and second skirt section ends which is formed when said first and second rows of securing means are in engagement is of sufficient length to form a substantially fluid-tight seal without requiring engagement of any said additional row of securing means, so as to prevent the escape of said contaminate material from a portion of said body of water in which said contaminate material is confined by said boom.

2. The boom of claim 1, wherein said ballast section is positioned at a sufficient depth below said flotation section to rest on a floor of said body of water so as to maintain said boom in a substantially fixed position with respect to said floor of said body of water.

3. The boom of claim 2, wherein said ballast section comprises a lead line.

4. The boom of claim 3, further comprising:

at least one attachment point on a lower edge of said flotation section for the attachment of additional anchoring means for assisting in maintaining said boom in said substantially fixed position against moving water forces in said body of water.

5. The boom of claim 4, wherein a plurality of said attachment points are arranged along said lower edge of said flotation section at intervals of about twenty feet.

6. The boom of claim 4, wherein said additional anchoring means comprises:

an anchor cable; and a conventional bottom-founded anchor attached to said anchor cable.

7. The boom of claim 3, wherein said lead line has a weight within the range from about 10 to 12 pounds per fathom.

8. The boom of claim 1, wherein said means for securing said overlapped first and second skirt section ends together comprises:

a substantially vertical row of loops attached to said skirt section proximate said first end of said skirt section; and a corresponding substantially vertical row of hooks attached to said skirt section proximate said second end of said skirt section for engaging said row of loops proximate said first end of said skirt section.

9. The boom of claim 8, further comprising a tow line attached to said flotation section proximate said first end of said skirt section for connecting said boom with a mobile watercraft.

10. The boom of claim 9, further comprising anchoring means attached to said boom proximate said second end of said skirt section for holding said second end substantially stationary in said body of water, so as to permit a single said mobile watercraft to deploy said boom in said body of water so that said boom encircles said portion of said body of water in which said contaminate material is confined, and to permit said watercraft to bring said first end around so that said first and second ends overlap one another.

11. The boom of claim 10, wherein said anchoring means comprises a sea anchor.

12. The boom of claim 10, further comprising means for contracting said boom about said portion of said body of water which is encircled by said boom so that said boom gathers said floating contaminate material together preparatory to recovery of said contaminate material.

13. The boom of claim 1, wherein said means for securing said overlapped first and second ends of said skirt section together comprises:

a plurality of rings attached in a substantially vertical row to said skirt section and said net section proximate said first end of said skirt section; and a plurality of snap hooks attached in a substantially vertical row to said skirt section and said net section proximate said second end of said skirt section for engaging said row of rings proximate said first end of said skirt section.

14. A horizontally elongate floating boom for confining contaminate material floating on the surface of a portion of a body of water, said boom comprising:

a flotation section for floating on said surface of said body of water;

a substantially vertical contaminate impervious skirt section extending downwardly from said flotation section for retaining said contaminate material, said skirt section having first and second ends which are adapted to overlap one another and which have edges which extend downwardly from said surface;

a substantially vertical net section extending downwardly from said skirt section for permitting the flow of subsurface water therethrough;

a ballast section attached along a lower edge of said net section for maintaining said skirt section and said net section in substantially vertical orientation;

a tow line attached to said flotation section proximate said first end of said skirt section for connecting said boom with a mobile watercraft;

anchoring means attached to said boom proximate said second end of said skirt section for holding said second end substantially stationary in said body of water, so as to permit a single said mobile watercraft to deploy said boom in said body of water;

a breast line connecting said lead line and said tow line so as to maintain said substantially vertical orientation of said first end of said skirt section during said deployment; and means for securing a said first end of a said skirt section and a said second end of a said skirt section together when said first and second ends are overlapped, so as to prevent the escape of said contaminate material from a portion of said body of water in which said contaminate material is confined by said boom.

15. A horizontally elongate floating boom for confining contaminate material floating on the surface of a portion of a body of water, said boom comprising:

a flotation section for floating on said surface of said body of water;

a substantially vertical contaminate impervious skirt section extending downwardly from said flotation section for retaining said contaminate material, said skirt section having first and second ends which are adapted to overlap one another and which have edges which extend downwardly from said surface;

a substantially vertical net section extending downwardly from said skirt section for permitting the flow of subsurface water therethrough;

a tow line attached to said flotation section proximate said first end of said skirt section for connecting said boom with a mobile watercraft;

anchoring means attached to said boom proximate said second end of said skirt section for holding said second end substantially stationary in said body of water, so as to permit a single said mobile watercraft to deploy said boom in said body of water so that said boom encircles a portion of said body of water on which said contaminate material is floating, and to permit said watercraft to bring said first end around so that said first and second ends overlap one another;

means for securing said first end of a said skirt section and said second end of a said skirt section together when said first and second ends are overlapped, so as to prevent the escape of said contaminate material from said portion of said body of water which is encircled by said boom;

a first purse line attached to said flotation section proximate said surface of said body of water, so that tension applied to at least one end of said first purse line will cause said flotation section to contract about said portion of said body of water which is encircled by said boom; and a second purse line attached to a lower edge of said skirt section, so that tension applied to at least one end of said second purse line will cause said lower edge of said skirt section to contract about said portion of said body of water which is encircled by said boom.

16. The boom of claim 15, wherein said means for contracting said boom further comprises;

a third purse line attached to a lower edge of said net section, so that tension applied to at least one end of said third purse line will cause said lower edge of said net section to contract about said portion of said body of water which is encircled by said boom.

17. The boom of claim 15, wherein said flotation section comprises:

a plurality of float pockets arranged in a substantially horizontal row, each said float pocket having flotation material contained therein; and a plurality of accordion pleats, at least one said accordion pleat being positioned intermediate each said float pocket and each next said float pocket in said row, so that each said float pocket folds against each next said float pocket as said flotation section contracts around said portion of said body of water.

18. A horizontally elongate floating boom for confining contaminate material floating on the surface of a portion of a body of water having a floor at a predetermined depth, said boom comprising:

a flotation section for floating on said surface of said body of water;

a substantially vertically contaminate impervious skirt section extending downwardly from said flotation section for retaining said contaminate material, said skirt section having first and second ends which are adapted to overlap one another and which have edges which extend downwardly from said flotation section;

a substantially vertical net section extending downwardly from said skirt section for permitting the flow of subsurface water therethrough, said net section having a lower edge at a distance below said flotation section such that said lower edge of said net section will be in contact with said floor of said body of water at said predetermined depth when said boom is deployed in said body of water;

a lead line attached along said lower edge of said net section for anchoring said boom to said floor of said body of water; and means for securing a said first end of a said skirt section and a said second end of a said skirt section together when said first and second ends are overlapped, said securing means comprising a first row of mechanical connectors extending downwardly across said skirt section proximate said first end of said skirt section and a second row of mechanical connectors configured to be engaged by said first row of connectors and extending downwardly across said skirt section proximate said second end of a said skirt section, said second row of connectors being spaced apart from said second end of said skirt section so as to form a flap portion of said skirt section which is substantially free of any additional vertically extending row of means for securing said second end of said skirt section to said first end of said skirt section, said flap portion having sufficient length that the overlap of said first and second skirt section ends which is formed when said first and second rows of securing means are in engagement is of sufficient length to form a substantially fluid-tight seal without requiring engagement of any said additional row of securing means, so as to prevent the escape of said contaminate material from said portion of said body of water in which said contaminate material is confined by said boom.

19. A horizontally elongate floating boom for catching contaminate material floating on the surface of a body of water, said boom comprising:

a flotation section for floating on said surface of said body of water;

a substantially vertical contaminate impervious skirt section extending downwardly from said flotation section for retaining said contaminate material, said skirt section having first and second ends which are adapted to overlap one another and which have edges which extend downwardly from said flotation section;

a substantially vertical net section extending downwardly from said skirt section for permitting the flow of subsurface water therethrough;

a ballast section attached along a lower edge of said net section for maintaining said skirt section and said net section in substantially vertical orientation;

means for securing said first and second ends of said skirt section together when said first and second ends are overlapped, said securing means comprising a first row of mechanical connectors extending downwardly across said skirt section proximate said first end of said skirt section and a second row of mechanical connectors configured to be engaged by said first row of connectors and extending downwardly across said skirt section proximate said second end of a said skirt section, said second row of connectors being spaced apart from said second end of said skirt section so as to form a flap portion of said skirt section which is substantially free of any additional vertical row of means for securing said second end of said skirt section to said first end of said skirt section, said flap portion having sufficient length that the overlap of said first and second skirt section ends which is formed when said first and second rows of securing means are in engagement is of sufficient length to form a substantially fluid-tight seal without requiring engagement of any said additional row of securing means, so as to prevent the escape of said contaminate material from a portion of said body of water which is encircled by said boom; and means for contracting said boom about said portion of said body of water which is encircled by said boom so that said boom gathers said floating contaminate material together preparatory to recovery of said contaminate material.

20. A horizontally elongate floating boom for catching contaminate material floating on the surface of a body of water, said boom comprising:

a flotation section for floating on said surface of said body of water;

a substantially vertical contaminate impervious skirt section extending downwardly from said flotation section for retaining said contaminate material, said skirt section having first and second ends which are adapted to overlap one another and which have edges which extend downwardly from said flotation section;

a substantially vertical net section extending downwardly from said skirt section for permitting the flow of subsurface water therethrough;

a ballast section attached along a lower edge of said net section for maintaining said skirt section and said net section in substantially vertical orientation;

means for securing said first and second ends of said skirt section together when said first and second ends are overlapped, so as to prevent the escape of said contaminate material from a portion of said body of water which is encircled by said boom;

a first purse line connected along said flotation section so that application of tension to at least one end of said first purse line will cause said flotation section to contract about said portion of said body of water which is encircled by said boom;

a second purse line connected along a lower edge of said skirt section so that application of tension to at least one end of said second purse line will cause said skirt section to contract about said portion of said body of water which is encircled by said boom; and a third purse line connected along a lower edge of said net section so that application of tension to at least one end of said third purse line will cause said net section to contract about a said portion of said body of water which is encircled by said boom.

21. A method for confining contaminate material floating on the surface of a body of water having a floor at a predetermined depth, said method comprising:

placing a first portion of at least one horizontally elongate floating boom in said body of water, said boom comprising:

a flotation section floating at said surface of said body of water;

a substantially vertical contaminate impervious skirt section extending downwardly from said flotation section, said skirt section having first and second ends which have edges which extend downwardly from said flotation section;

a net section extending downwardly from said skirt section a sufficient distance so that a lower edge of said net section is in contact with said floor of said body of water at said predetermined depth; and a lead line attached to said lower edge of said net section for anchoring said boom to said floor, so as to hold said first end of said skirt section in a substantially fixed position relative to said floor of said body of water;

paying out a second portion of said boom from a moving watercraft into said body of water, said second portion of said boom having said second end of said skirt section thereon, so as to segregate a portion of said body of water having said contaminate material floating thereon;

connecting a tow line from said flotation section proximate said second end of said skirt section to said watercraft;

connecting a breast line from said lead line to said tow line so as to maintain said second end of said skirt section in substantially vertical orientation during towing of said boom.

towing said boom with said watercraft so as to overlap a said second end of a said skirt section against a said first end of a said skirt section so as to confine said contaminate material to said portion of said body of water which is segregated by said boom; and securing said overlapped first end of said skirt section and second end of said skirt section together so as to prevent the escape of said contaminate material from said portion of said body of water which is segregated by said boom.

22. The method of claim 21, further comprising:

placing a plurality of said horizontally elongate booms in said body of water along a line intermediate a first portion of said body of water having said contaminate material floating thereon and a second portion of said body of water which is substantially free of said contaminate material, so that each said first end of a said skirt section on a said boom overlaps against a said second end of a said skirt section on another said boom, whereby a fence-like barrier is formed which segregates said first portion of said body of water from said second portion of said body of water.

23. The method of claim 21, wherein the step of paying out said second portion of said boom so as to segregate a portion of said body of water further comprises paying out said second portion of said boom from said moving watercraft along a path about said portion of said body of water, so as to encircle said portion of said body of water having said contaminate material floating thereon with said boom.

24. The method of claim 21, further comprising: attaching at least one additional anchoring means to said flotation section of said boom, so as to provide additional anchoring capability to for holding said boom in said substantially fixed position relative to said floor of said body of water.

25. A method for catching contaminate material floating on the surface of a body of water, said method comprising:

placing a horizontally elongate floating boom in said body of water, said boom comprising:

a flotation section floating at said surface of said body of water;

a substantially vertical contaminate impervious skirt section extending downwardly from said flotation section and having first and second ends which have edges which extend downwardly from said flotation section;

a net section extending downwardly from said skirt section; and a lead line attached along a lower edge of said net section;

attaching anchoring means to a first end of said boom so as to hold said first end of said boom substantially stationary in said body of water;

towing said boom from a watercraft attached to a second end of said boom along a path about a portion of said body of water having said contaminate material floating thereon, so as to encircle said portion of said body of water with said boom;

overlapping said second and first ends of said skirt section so as to enclose said portion of said body of water which is encircled by said boom;

securing said overlapped second and first ends of said skirt section together so as to prevent the escape of said contaminate material from said portion of said body of water which is encircled by said boom; and contracting said boom about said portion of said body of water which is encircled by said boom without detaching said secured together first and second ends of said skirt section from each other, so as to gather said contaminate material into a more compact mass for removal while preventing escape of said contaminate material as said boom is contracted.

26. The method of claim 25, wherein said step of attaching anchoring means to said first end of said boom comprises attaching a sea anchor to said first end of said boom.

27. A method for catching contaminate material floating on the surface of a body of water, said method comprising:

placing a horizontally elongate floating boom in said body of water, said boom comprising:

a flotation section floating at said surface of said body of water;

a substantially vertical contaminate impervous skirt section extending downwardly from said flotation section and having first and second ends which have edges which extend downwardly from said flotation section;

a net section extending downwardly from said skirt section;

a lead line attached along a lower edge of said net section;

a first purse line attached along said flotation section; and a second purse line attached along a lower edge of said skirt section;

attaching anchoring means to a first end of said boom so as to hold said first end of said boom substantially stationary in said body of water;

towing said boom from a watercraft attached to a second end of said boom along a path about a portion of said body of water having said contaminate material floating thereon, so as to encircle said portion of said body of water with said boom;

overlapping said second and first ends of said skirt section so as to enclose said portion of said body of water which is encircled by said boom;

securing said overlapped second and first ends of said skirt section together so as to prevent the escape of said contaminate material from said portion of said body of water which is encircled by said boom;

applying tension to at least one end of said first purse line so as to contract said flotation section about said portion of said body of water which is encircled by said boom; and applying tension to at least one end of said second purse line so as to contract said lower edge of said skirt section about said portion of said body of water which is encircled by said boom.

28. The method of claim 27, wherein said boom further comprises a third purse line attached along a lower edge of said net section, and wherein said step of contracting said boom about said portion of said body of water which is encircled by said boom further comprises:

applying tension to at least one end of said third purse line so as to contract said lower edge of said net section about said portion of said body of water which is encircled by said boom.

29. The method of claim 28, further comprising:

contracting said lower edge of said net section so as to cinch said lower edge of said net section closed, whereby solid portions of said contaminate material which may sink while awaiting said removal are retained by said boom.

30. The method of claim 28, further comprising:

contracting said lower edge of lower edge of said skirt section so as to cinch said lower edge of said net section closed;

contracting said flotation section so as to cinch said flotation section closed; and hoisting said boom out of said body of water so as to remove from said body of water said contaminate material which is on said portion of said body of water encircled by said boom.

* * * * *